US006115231A

United States Patent [19]

Shirakawa

[11] Patent Number: 6,115,231

[45] Date of Patent: Sep. 5, 2000

[54] ELECTROSTATIC RELAY

[75] Inventor: Yukihiko Shirakawa, Chiba, Japan

[73] Assignee: TDK Corporation, Tokyo, Japan

[21] Appl. No.: 09/196,128

[22] Filed: Nov. 20, 1998

[30] Foreign Application Priority Data

Nov. 25, 1997 [JP] Japan ..... 9-339309
Jan. 12, 1998 [JP] Japan ..... 10-014754

[51] Int. Cl.[7] ..... H01H 59/00

[52] U.S. Cl. ..... 361/233; 200/181

[58] Field of Search ..... 361/233–235; 200/181

[56] References Cited

U.S. PATENT DOCUMENTS

| | | | |
|---|---|---|---|
| 4,078,183 | 3/1978 | Lewiner et al. | 200/181 |
| 5,629,565 | 5/1997 | Schlaak et al. | 200/181 |
| 5,666,258 | 9/1997 | Gevatter et al. . | |
| 5,677,823 | 10/1997 | Smith | 361/233 |

FOREIGN PATENT DOCUMENTS

| | | |
|---|---|---|
| 2-100224 | 4/1990 | Japan . |
| 3-112032 | 5/1991 | Japan . |
| 4-58430 | 2/1992 | Japan . |
| 405002975 | 1/1993 | Japan . |
| 405002977 | 1/1993 | Japan . |
| 405002978 | 1/1993 | Japan . |
| 8-506690 | 7/1996 | Japan . |

*Primary Examiner*—Fritz Fleming
*Attorney, Agent, or Firm*—Oblon, Spivak, McClelland, Maier & Neustadt, P.C.

[57] ABSTRACT

An electrostatic relay comprises: a torsional elasticity portion supported on a substrate such that a gap is maintained from the substrate and arranged to have a beam shape; a movable structure portion which can be rotated by dint of elastic support of the torsional elasticity portion; at least one movable contact provided for at least an end of the movable structure portion; a movable electrode disposed between a fulcrum P of rotation of the movable structure portion and the movable contact; at least one fixed contact formed on the substrate at a position opposite to the movable contact such that contact is permitted; and a fixed electrode formed on the substrate at a position opposite to the movable electrode, wherein at least a portion between the fulcrum P of rotation of the movable structure portion and the movable contact is formed into an elastic connection portion.

15 Claims, 19 Drawing Sheets

ELECTROSTATIC RELAY

BACKGROUND OF THE INVENTION

The present invention relates to an electrostatic relay incorporating an electrostatic actuator which uses electrostatic attractive force as a drive source thereof.

An electrostatic relay is different from a conventional electromagnetic relay which uses an electromagnet in a structure that electrostatic attractive force is used as drive force to open/close contacts thereof. Since any coil for generating electromagnetic force is not required, the number of mechanical elements can be reduced. Moreover, the size reduction can be permitted. Since the electrostatic actuator, which is intrinsically a capacitor, is employed as the drive source, electric power consumption can be reduced. Therefore, research and development have been performed to put the electrostatic relay to practical use.

An electrostatic relay of the foregoing type has been disclosed in, for example, Japanese Patent Laid-Open No. 2-100224. That is, single crystal Si is selectively etched so that an elastic torsion bar and a seesaw structure connected to the elastic torsion bar are formed. Moreover, a movable electrode of the electrostatic actuator and a movable contact of the relay are provided for the seesaw structure so as to be disposed on an electrically insulating substrate through a spacer, the electrically insulating substrate having a fixed electrode and a fixed contact disposed at opposite positions.

The above-mentioned electrostatic relay has a structure that the elastic torsion bar is twisted when voltage is applied between the fixed electrode and the movable electrode when the electrostatic relay is operated. Thus, the seesaw structure in the portion applied with the voltage performs a rotational motion so that the movable contact is brought into contact with the fixed contact.

The above-mentioned conventional electrostatic relay has the following problem when a relay contact in the form of a pair of the movable contact and a fixed contact is opened/closed.

When the relay contact is closed, the conventional electrostatic relay is arranged such that voltage is applied between the movable electrode of the electrostatic actuator provided for the seesaw structure adjacent to the target contact and the fixed electrode adjacent to the substrate. Electrostatic attractive force acting between the two electrodes is used to cause the seesaw structure to perform a seesaw motion such that the elastic torsion bar serves as a fulcrum of rotation. Thus, the movable contact is brought into contact with the fixed contact so that the contact is closed.

Since the foregoing electrostatic relay has the movable contact provided for the end of the seesaw structure, the movable contact is brought into contact with the fixed contact in a state in which the movable contact is inclined. Therefore, a satisfactorily large contact area cannot be realized and the contact resistance is raised excessively. If the position of the structure which is provided with the movable contact is not appropriately selected, the structure is undesirably brought into contact together with the movable contact. Thus, there is a possibility that the pressure between the contacts becomes insufficiently low.

The electrostatic relay having the above-mentioned structure is formed such that the movable electrode opposite to the fixed electrode is formed adjacent to the fulcrum of rotation as compared with the movable contact of the seesaw structure held by the elastic torsion bar such that a gap is maintained. Therefore, when the movable contact has been brought into contact with the fixed contact and thus the rotational motion of the seesaw structure has been interrupted, a wedge shape air gap is generated between the fixed electrode and the movable electrode.

However, the electrostatic attractive force is in proportion to the inverse square of the gap between the two electrodes. Therefore, the electrostatic actuator encounters reduction in the electrostatic attractive force owning to the great air gap even during the suction operation. Since a sufficiently high pressure is not applied to the contact, the resistance of the contact cannot satisfactorily be reduced. If the operating voltage is raised to overcome the foregoing problem, the practicality of the electrostatic relay excessively deteriorates.

If the resistance of the contact is high, the contact is overheated by dint of Joule heat when a contact electric current is supplied. Thus, a phenomenon that the contact is melted easily takes place. When the operating voltage is raised to reduce the high contact resistance so as to raise the contact pressure, the practicality of the electrostatic relay excessively deteriorates.

When the relay contact is opened, the following problem arises.

That is, when the relay contact is opened, the movable contact and the fixed contact must be separated from each other. In the foregoing case, the fixed electrode and the movable electrode of the electrostatic actuator are short-circuited to make the electrostatic attractive force between the electrodes to be zero. As a result, restoring force of the elastic torsion bar which rotatably supports the seesaw structure acts so that the movable contact is moved upwards. Thus, the contact with the fixed contact is suspended.

As described above, when the relay contact of the conventional electrostatic relay is opened, only the restoring force of the elastic torsion bar serving as the torsional elastic member is the separating force. If a high contact electric current is applied and thus the contact is melted, the force for forcibly separating the contacts from each other is insufficiently small.

To prevent the above-mentioned fact, the restoring force of the elastic torsion bar is required to be enlarged. In the foregoing case, also the force for closing the relay contact is enlarged. Therefore, the voltage which must be applied to the electrostatic relay must be raised. Thus, the practicality of the electrostatic relay excessively deteriorates.

As a method of enlarging the force for opening the relay contact, a method may be employed whereby voltage is applied between the fixed electrode and the movable electrode of the electrostatic actuator (hereinafter called an "opposite electrode") opposite to the closed contact of the seesaw structure of the electrostatic relay so as to generate electrostatic attractive force. Thus, the force for upward moving the seesaw structure closing the contact is generated.

However, since the movable electrode of the electrostatic actuator of the opposite electrode is moved upwards, the distance from the fixed electrode is elongated.

Since the force for rotating the seesaw structure is the force of a lever, the force is a product of a distance from the central axis of rotation and the attractive force at the foregoing position. The distance between the fixed electrode and the movable electrode is elongated in proportion to the distance from the central axis of rotation. Since the electrostatic attractive force acting at the electrodes is in proportion to the inverse square of the distance between the electrodes, the attractive force of the electrostatic actuator at the opposite electrode is reduced excessively. Therefore, the foregoing attractive force cannot satisfactorily separate the contacts from each other. Thus, if the voltage which is applied to the opposite electrode is not raised, the force for separating the relay contact cannot easily be enlarged.

As described above, the conventional electrostatic relay encounters excessively high contact resistance when the contact has been closed. Thus, the phenomenon that the contact is melted easily takes place. Since the force for separating the contacts from each other is too small, a failure that the contacts are melted takes place if the contacts are melted. Therefore, a satisfactorily high contact electric current cannot be maintained. Thus, the reliability and practicality are unsatisfactory. To solve the above-mentioned problems, the voltage for operating the electrostatic relay must be raised. However, the high operating voltage excessively deteriorates the practicality of the electrostatic relay.

SUMMARY OF THE INVENTION

In view of the foregoing, an object of the present invention is to provide a practical electrostatic relay exhibiting low-voltage operation, low contact resistance and a large contact capacity.

To achieve the foregoing objects, according to first aspect of the present invention, there is provided an electrostatic relay comprising: a substrate; a torsional elasticity portion supported on the substrate such that a gap is maintained from the substrate and arranged to have a beam shape; a movable structure portion which can be rotated by dint of elastic support of the torsional elasticity portion; at least one movable contact provided for at least an end of the movable structure portion; a movable electrode disposed between a fulcrum of rotation of the movable structure portion and the movable contact; at least one fixed contact formed on the substrate at a position opposite to the movable contact such that contact is permitted; and a fixed electrode formed on the substrate at a position opposite to the movable electrode, wherein at least a portion between the fulcrum of rotation of the movable structure portion and the movable contact is formed into an elastic connection portion.

It is preferable that the electrostatic relay has a structure that the elastic connection portion is formed between the movable electrode and the movable contact of the movable structure portion, and when voltage is applied between the movable electrode and the fixed electrode, elastic deformation causes the movable contact and the fixed contact to be brought into contact with each other in a parallel state.

It is preferable that the elastic connection portion is formed between the fulcrum of rotation of the movable structure portion and the movable electrode, when voltage is applied between the movable electrode and the fixed electrode, elastic deformation causes the movable electrode to be sucked in parallel with the fixed electrode or into an approach state near the parallel state.

A dielectric layer may be interposed between the movable electrode and the fixed electrode.

A structure may be employed in which the movable structure portion extends to two sides of the torsional elasticity portion in the form of the beam shape, the movable contact is provided for at least either side with respect to the fulcrum of rotation, the movable electrodes are provided for both sides, and the fixed electrodes are formed on the substrate at positions opposite to the movable electrodes. To achieve the foregoing objects, according to second aspect of the present invention, there is provided an electrostatic relay comprising: a substrate; a torsional elasticity portion supported on the substrate such that a gap is maintained from the substrate and arranged to have a beam shape; a movable structure portion disposed to intersect the torsional elasticity portion and elastically supported by the torsional elasticity portion so that rotation is permitted; movable electrode portions ratably provided for both sides of a fulcrum of rotation of the movable structure portion through elastic connection portions; movable electrodes constituted by the movable electrode portions or provided for the movable electrode portions; fixed electrodes disposed on the substrate at positions opposite to the movable electrodes; at least one movable contact provided for at least an end of the movable structure portion; and a fixed contact disposed on the substrate at a position opposite to the movable contact such that contact is permitted.

It is preferable that the foregoing electrostatic relay has a structure that a movable end of each of the movable electrode portions is disposed adjacent to the fulcrum of rotation of the movable structure portion.

It is preferable that the elastic connection portion has a structure with which the movable electrode is caused to approach the fixed electrode by dint of elastic deformation when voltage is applied between the movable electrode and the fixed electrode.

Another structure may be employed in which a dielectric layer is interposed between the movable electrode and the fixed electrode.

BRIEF DESCRIPTION OF THE DRAWINGS

FIG. 3 is a side cross sectional view showing an intermediate state in which the contacts according to the first embodiment are being turned on;

FIG. 21 is a front cross sectional view showing an intermediate state in which the contacts according to the fifth embodiment is being turned on;

DETAILED DESCRIPTION OF THE PREFERRED EMBODIMENTS

Figure 1:
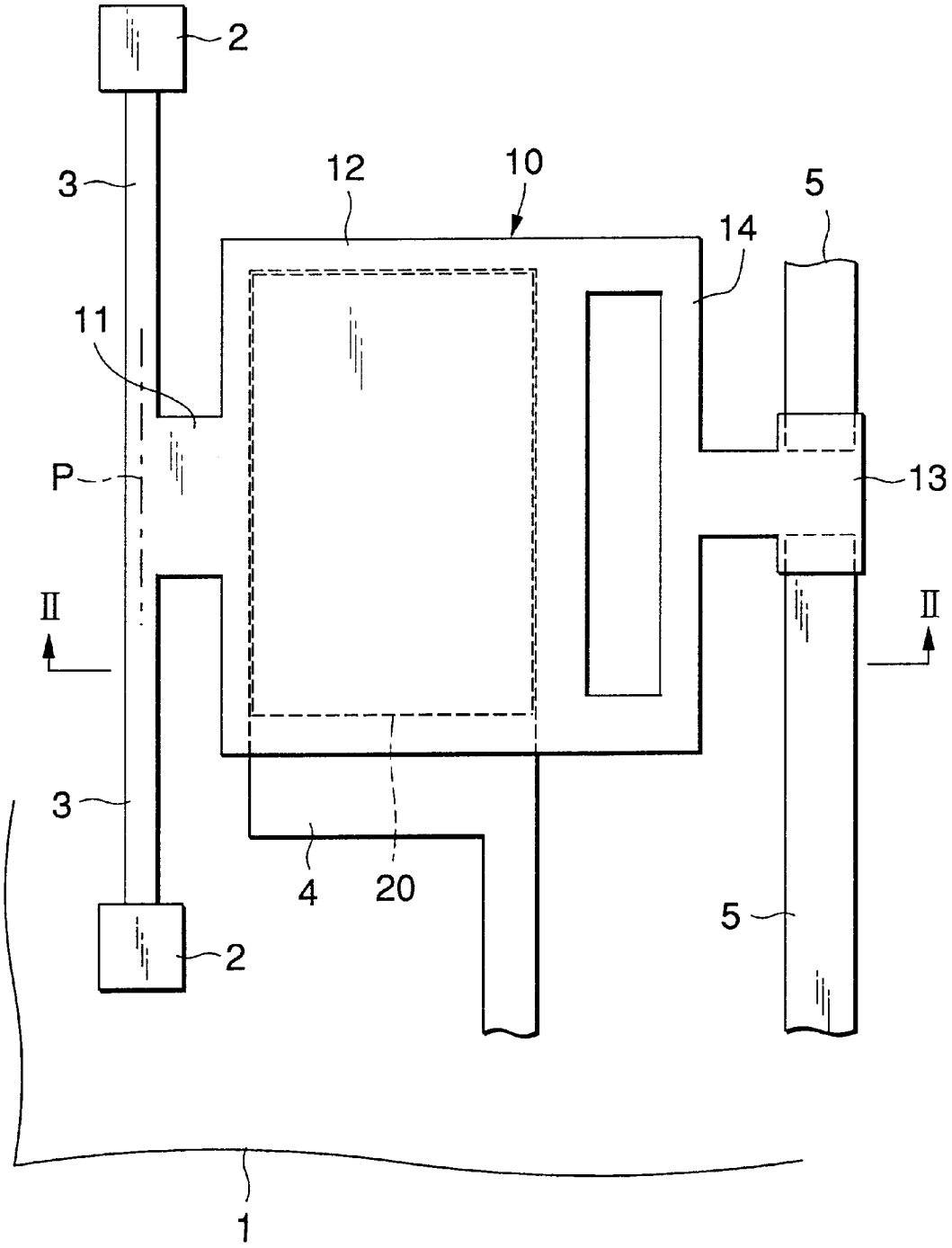
FIG. 1 is a plan view showing a first embodiment of an electrostatic relay according to the present invention.

Embodiments of an electrostatic relay according to first aspect of the present invention will now be described with reference to the drawings.

First Embodiment

FIGS. 1 to 4 show a first embodiment of an electrostatic relay according to the present invention. Referring to the drawings, the electrostatic relay incorporates an insulating substrate 1, an anchor structure 2 stood erect on the substrate 1 and secured to the same, an elastic torsional portion 3 held such that a gap is maintained from the substrate 1 and formed into a beam shape and a movable structure portion 10 formed into a relay structure which is able to rotate by dint of elastic support performed by the elastic torsional portion 3. The insulating substrate 1 has a structure that at least the surface thereof is subjected to an insulating process. For example, the substrate 1 is a single crystal Si substrate having a SiO2 insulating layer formed on the surface thereof. The three elements, which are the anchor structure 2, the elastic torsional portion 3 in the form of the beam shape and the movable structure portion 10, are integrally formed by polycrystal Si or the like.

The movable structure portion 10 constituting the relay structure incorporates a beam connection portion 11 connected to the elastic torsional portion 3, a movable-electrode support portion 12, a movable-contact support portion 13 and an elastic connection portion 14 for connecting the movable-electrode support portion 12 and the movable-contact support portion 13 to each other. The elastic connection portion 14 is formed into the beam shape. When the elastic connection portion 14 is twisted, the movable-contact support portion 13 can be rotated.

Figure 2:
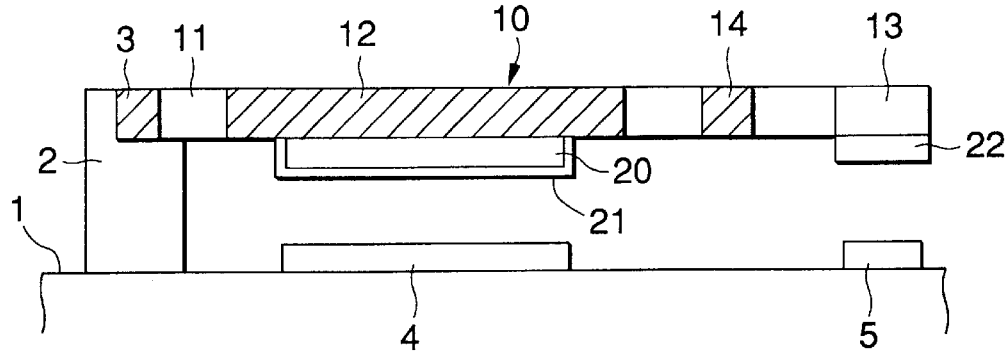
FIG. 2 is a side cross sectional view taken along line II—II shown in FIG. 1.
Figure 3:
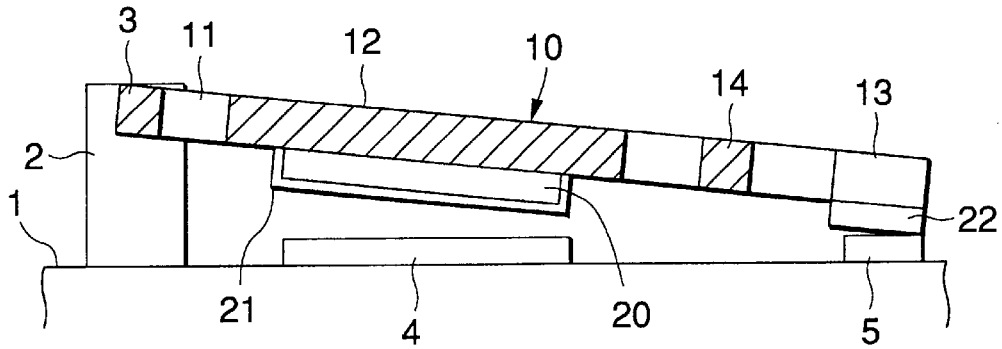
Figure 4:
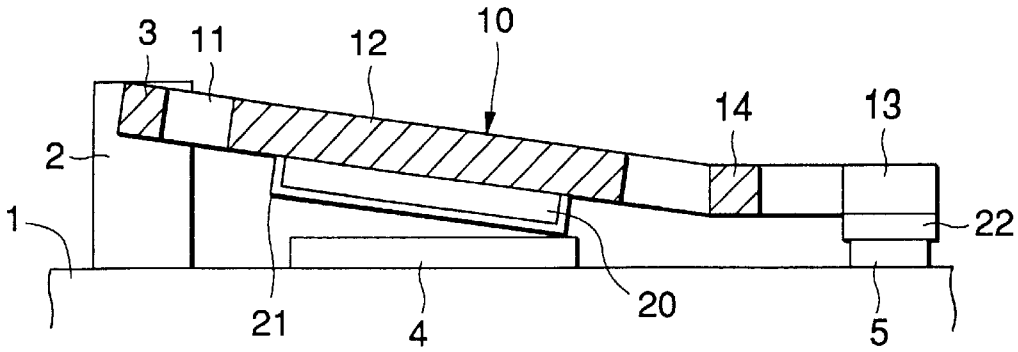
FIG. 4 is a side cross sectional view showing a state in which the operation for turning the contacts according to the first embodiment on has been completed.
Figure 5:
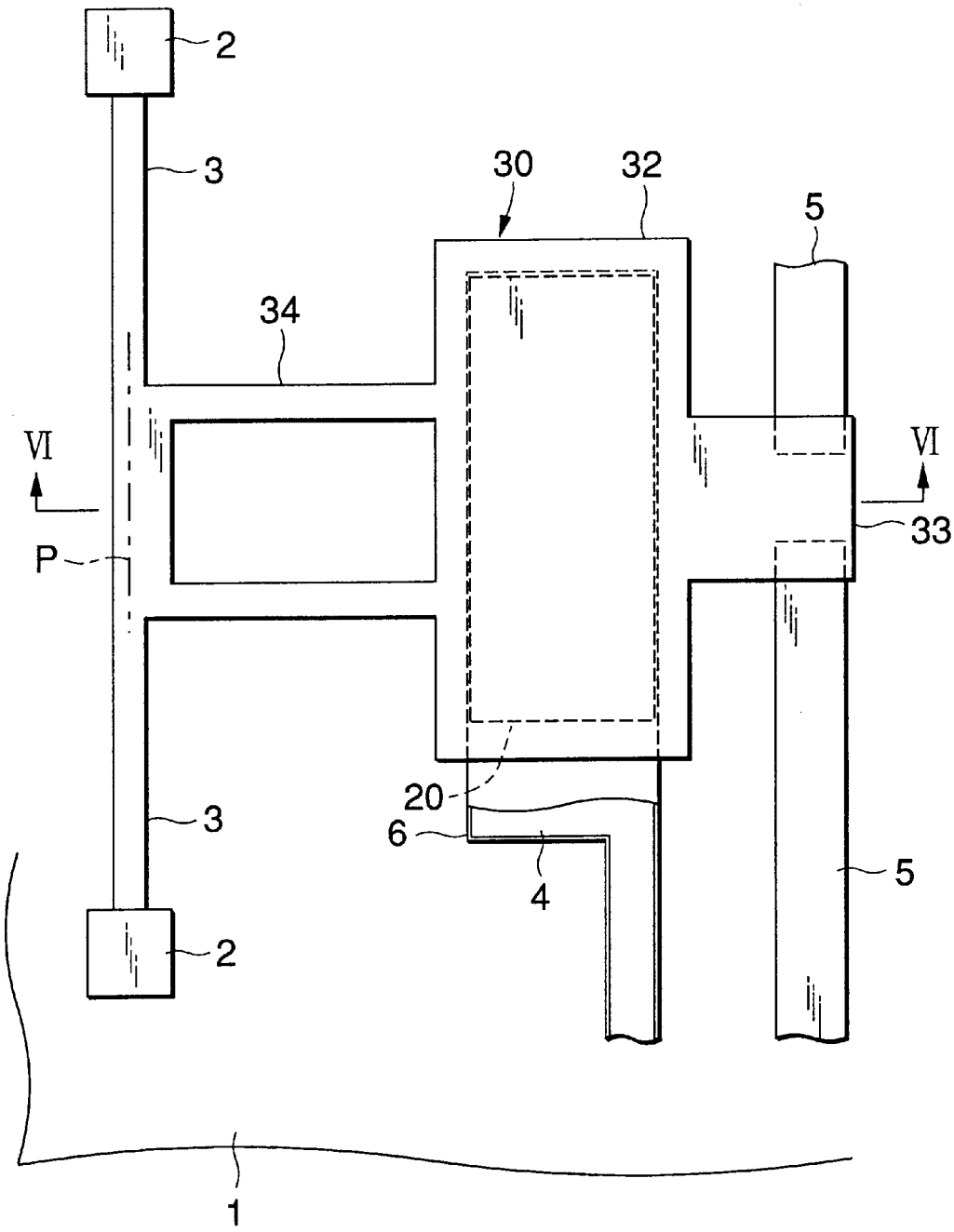
FIG. 5 is a plan view showing a second embodiment of the present invention.

The movable structure portion 10 which is the relay structure has, on the surface opposite to the substrate, a movable electrode 20, an insulating layer (a dielectric layer) 21 covering the surface of the movable electrode 20 and a movable contact 22, as shown in FIGS. 2 to 4. A fixed electrode 4 and a fixed contact 5 are formed on the surface of the substrate opposite to the foregoing surface of the movable structure portion 10. The fixed electrode 4 secured to the surface of the insulating substrate 1 and the movable electrode 20 secured to the movable-electrode support portion 12 constitute an electrostatic actuator which generates electrostatic attractive force when voltage is applied between the electrodes. The fixed electrode 4 and the movable electrode 20 are connected to an outer power source through electric wires (not shown).

The principle of the operation of the electrostatic relay according to the first embodiment will now be described. FIG. 2 shows the positions of the electrodes and the contacts in a non-operation state (in a state where no voltage is applied). In the foregoing state, the portion between the contacts 5 and 22 is opened. When voltage is applied between the fixed electrode 4 and the movable electrode 20 constituting the electrostatic actuator, electrostatic attractive force is generated between the two electrodes. As shown in FIG. 3, the movable structure portion 10 which is the relay structure is rotated toward the substrate by dint of the torsional elasticity of the elastic torsional portion 3 in the form of the beam shape until the movable contact 22 is brought into contact with the fixed contact 5. The fulcrum of rotation is the position of line P shown in FIG. 1.

The operation of the relay structure of the conventional electrostatic relay was interrupted in this state. At this time, the movable contact 22 and the fixed contact 5 are in a state of point contact as can be understood from FIG. 3. Therefore, a satisfactorily large contact area cannot be obtained and the contact resistance is raised excessively. Since the contact point is too small to reduce the resistance, electric currents are concentrated. Thus, the temperature of the contact is raised and therefore a failure of a type that the contact is melted easily takes place. Since the distance from the fixed electrode 4 to the movable electrode 20 of the electrostatic actuator is too long, satisfactorily large electrostatic attractive force cannot be generated. Therefore, a satisfactorily contact pressure cannot be realized. It leads to a fact that the contact resistance is raised. To raise the contact pressure, higher voltage must be applied. In this case, the operating voltage for the electrostatic relay is raised excessively to realize practicality.

However, the electrostatic relay according to this embodiment has a structure that the elastic connection portion 14 is deformed by dint of the sucking force of the electrostatic actuator. Thus, the elastic connection portion 14 is deformed such that the movable contact 22 is brought to be parallel to the fixed contact 5, as shown in FIG. 4. As can be understood from FIG. 4, the contacts 5 and 22 are in plane contact with each other such that the contacts 5 and 22 are in parallel with each other. Thus, a pair of the fixed contact 5 is short-circuited by the movable contact 22 so that sufficiently low contact resistance and a satisfactorily large contact electric current capacity can be realized. Moreover, the distance between the electrodes 4 and 20 of the electrostatic actuator can considerably be shortened as compared with the state shown in FIG. 3. Since the electrostatic attractive force is in inverse proportion to the square of the distance between the electrodes, a sufficiently high pressure can be applied to the contacts even if the operating voltage is low. Thus, the characteristics of low contact resistance and a low operating voltage, which cannot be realized by the conventional electrostatic relay, can be realized.

If the voltage between the electrodes 4 and 20 is made to be zero, the deformation caused from the torsional elasticity of the elastic torsional portion 3 can be restored. Thus, the movable structure portion 10 is restored to the non-operation state shown in FIG. 2.

According to the first embodiment, the following effects can be obtained.

The elastic connection portion 14 is disposed between the movable electrode 20 and the movable contact 22 of the movable structure portion 10 constituting the relay structure. When voltage is applied between the fixed electrode 4 and the movable electrode 20, the deformation caused from the torsional elasticity causes the fixed contact 5 and the movable contact 22 to be brought into contact with other in the parallel state. Therefore, the contacts 5 and 22 can be brought into plane contact with each other so that sufficiently low contact resistance and a satisfactorily large contact electric current capacity are obtained.

The distance between the electrodes 4 and 20 of the electrostatic actuator can considerably be shortened as compared with the state of FIG. 3 which is a limit of the conventional structure. Even if the electrostatic attractive force is enlarged and the operating voltage is low, sufficiently high pressure can be applied to the contacts. Therefore, an electrostatic relay which can be operated with low operating voltage can be realized.

Since the movable electrode 20 is covered with the insulating layer 21, a problem of short circuit that the electrodes 4 and 20 are brought into direct contact with each other can reliably be prevented. Although the insulating layer 21 is interposed between the movable electrode 20 and the fixed electrode 4, reduction in the electrostatic attractive force caused from existence of the insulating layer 21 is not required to be considered (ignored) because the insulating layer 21 is made of a dielectric material having a high dielectric constant as compared with that of air.

Although the first embodiment has the structure that the elastic connection portion 14 uses the torsional elasticity of the beam, the structure of the elastic connection portion is not limited to this. The required structure is such that the elastic connection portion is disposed to cause the movable contact and the fixed contact to be brought into contact with each other in a parallel state by dint of the elastic deformation when the operating voltage is applied to the electrostatic relay. Thus, the elastic modulus is required to enable deformation to take place with which the electrostatic attractive force generated between the fixed electrode and the movable electrode are brought into contact with each other in a parallel state. For example, a cantilever beam shape extending from the movable-electrode support portion 12 may be employed to obtain a similar effect.

Second Embodiment

FIGS. 5 to 8 show a second embodiment of the present invention. Referring to the drawings, a movable structure portion 30 constituting a relay structure is held such that a gap is maintained from a substrate 1 through an anchor structure 2 by an elastic torsional portion 3 in the form of the beam shape. The movable structure portion 30 incorporates a movable-electrode support portion 32, a movable contact support portion 33 and an elastic connection portion 34 for connecting the elastic torsional portion 3 in the form of the beam shape and the movable-electrode support portion 32 to each other with a predetermined length. The elastic connection portion 34 formed into a plurality of sections which are narrower than the movable-electrode support portion 32. Elastic deformation (deformation caused from deflection) in a direction perpendicular to the upper and lower surfaces causes the movable-electrode support portion 32 and the movable contact support portion 33 to be deformed and moved.

Figure 6:
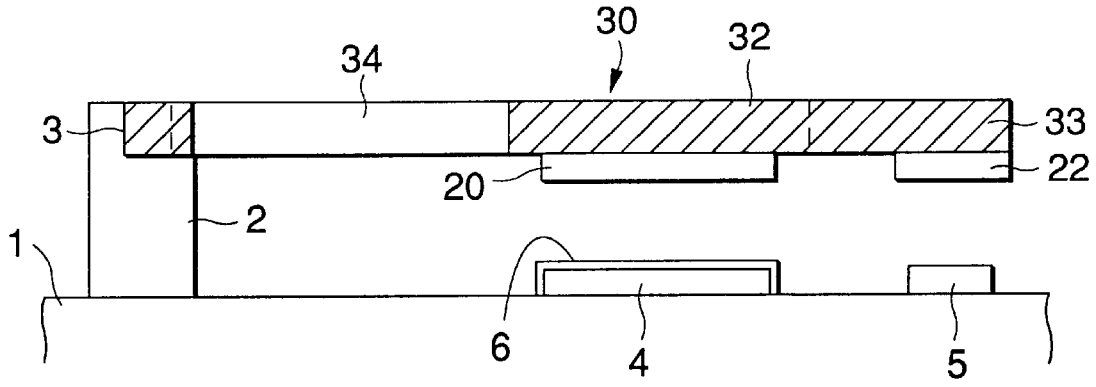
FIG. 6 is a side cross sectional view taken along line VI—VI shown in FIG. 5.
Figure 7:
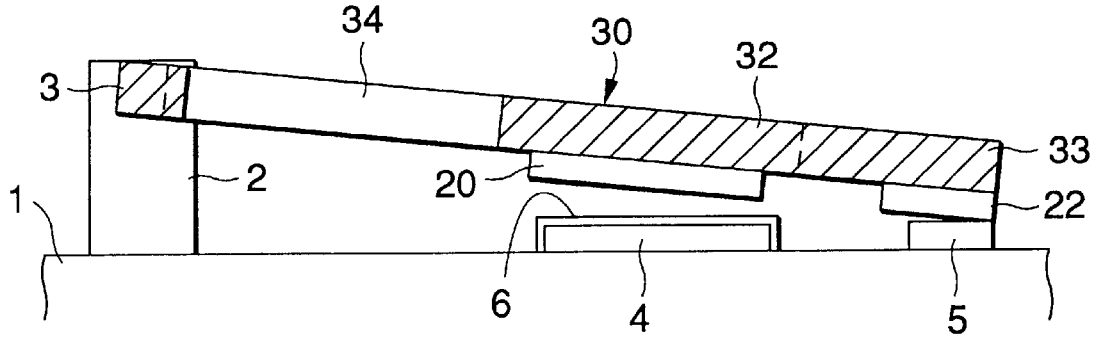
FIG. 7 is a side cross sectional view showing an intermediate state of an operation for turning the contacts on in the second embodiment.
Figure 8:
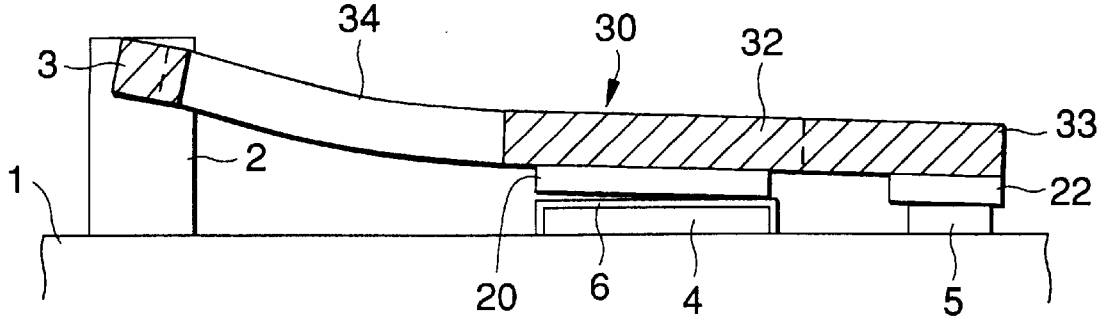
FIG. 8 is a side cross sectional view showing a state in which the operation for turning the contacts on in the second embodiment has been completed.

A movable electrode 20 and a movable. contact 22 are formed on the surface of the movable structure portion 30 which is the relay structure opposite to the substrate, as shown in FIGS. 6 to 8. A fixed electrode 4, an insulating layer (a dielectric layer) 6 covering the surface of the fixed electrode 4 and a fixed contact 5 are formed on the surface of the substrate opposite to the foregoing elements. The fixed electrode 4 secured to the surface of the substrate 1 and the movable electrode 20 secured to the movable-electrode support portion 32 constitute an electrostatic actuator which generates electrostatic attractive force when voltage is applied between the fixed electrode 4 and the movable electrode 20.

The other structures are similar to those according to the first embodiment.

The principle of the operation of the electrostatic relay according to the second embodiment will now be described. FIG. 6 shows the positions of the electrodes and contacts in a non-operation state (in a state in which no voltage is applied). The space between the contacts 5 and 22 is opened. When voltage is applied between the fixed electrode 4 and the movable electrode 20 constituting the electrostatic actuator, electrostatic attractive force is generated between the two electrodes. Thus, the movable structure portion 30 which is the relay structure is, as shown in FIG. 7, rotated toward the substrate until the movable contact 22 is brought into contact with the fixed contact 5 by dint of the torsional elasticity of the elastic torsional portion 3 in the form of the beam shape.

In the conventional electrostatic relay, the operation of the relay structure is interrupted at the foregoing time. Therefore, there arise problems of insufficiently small contact area, unsatisfactorily low contact pressure and high operating voltage as described above when the operation of the first embodiment has been described.

However, the electrostatic relay according to this embodiment has the structure that the elastic connection portion 34 having a predetermined length is deflected and deformed by dint of the sucking force of the electrostatic actuator. Thus, as shown in FIG. 8, the movable electrode 20 and the fixed electrode 4 are brought to a parallel state or a state near the parallel state. Also the movable contact 22 and the fixed contact 5 are deformed so that they are brought to the parallel state. As can be understood from FIG. 8, the contacts 5 and 22 are in plane contact with each other in the parallel state at the foregoing time. Thus, sufficiently low contact resistance and a large contact electric current capacity can be obtained. Moreover, the distance between the electrodes 4 and 20 of the electrostatic actuator can be shortened such that they are substantially in contact with each other through the insulating layer 6 as compared with the state shown in FIG. 7. Thus, considerably large electrostatic attractive force can be generated. Therefore, a sufficiently high pressure can be applied to the contacts even with low operating voltage. Thus, the characteristics of low contact resistance and low operating voltage, which cannot easily be realized by the conventional electrostatic relay, can easily be realized.

As described above, according to the second embodiment, the elastic connection portion 34 which can be deflected and deformed and which has a predetermined length is disposed between a rotation fulcrum P (a center of torsion of the elastic torsional portion 3 in the form of the beam shape) of the movable structure portion 30 which is the relay structure and the movable electrode 20. Thus, when voltage is applied between the fixed electrode 4 and the movable electrode 20, the movable electrode 20 can be sucked in parallel to the fixed electrode 4 or into a state near the parallel state by dint of elastic deformation. Thus, the electrostatic attractive force can be enlarged. Moreover, the contacts 5 and 22 are brought into plane contact with each other so that sufficient low contact resistance and a satisfactorily large contact electric current capacity can be obtained. Thus, an electrostatic relay exhibiting low operating voltage can be realized.

The second embodiment has elastic connection portion 34 formed such that the elastic deformation of the elongated portion of the movable structure portion 30 having a predetermined length in the perpendicular direction with respect to the substrate is used. The structure of the elastic connection portion is not limited to the foregoing structure. The elastic connection portion is required to be disposed in such a manner that the movable electrode and the fixed electrode are in parallel with each other by dint of elastic deformation when operating voltage is applied to the electrostatic relay. Thus, the elastic modulus is required with which the electrostatic attractive force generated between the fixed electrode and the movable electrode enables deformation to be performed in such a manner that the two electrodes are in parallel with each other or in a state near the parallel state. For example, torsional rotation of the beam of the elastic connection portion 14, for example, as shown in FIG. 1 may be employed to obtain a similar effect.

Third Embodiment

Figure 9:
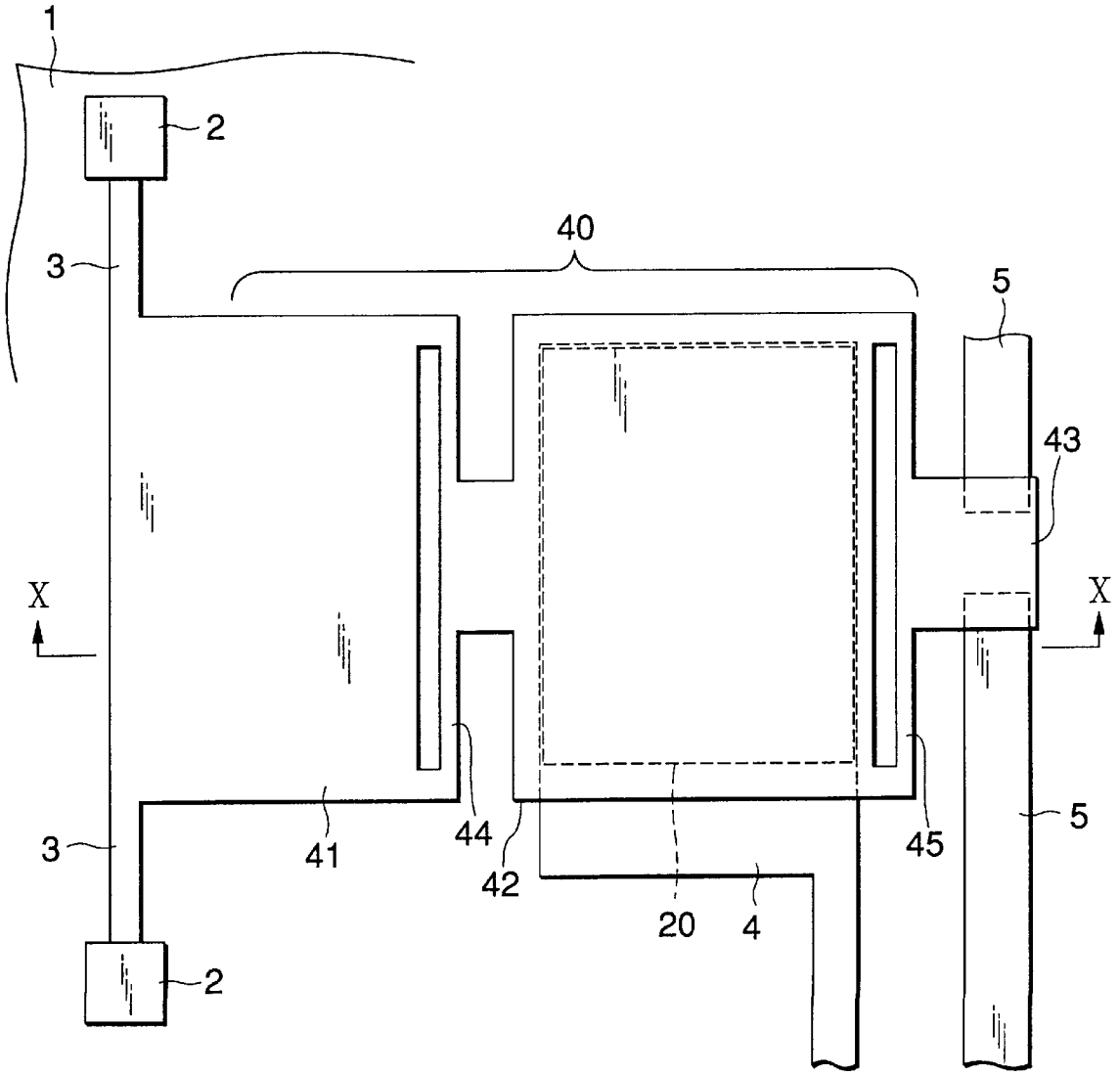
FIG. 9 is a plan view showing a third embodiment of the present invention.
Figure 10:
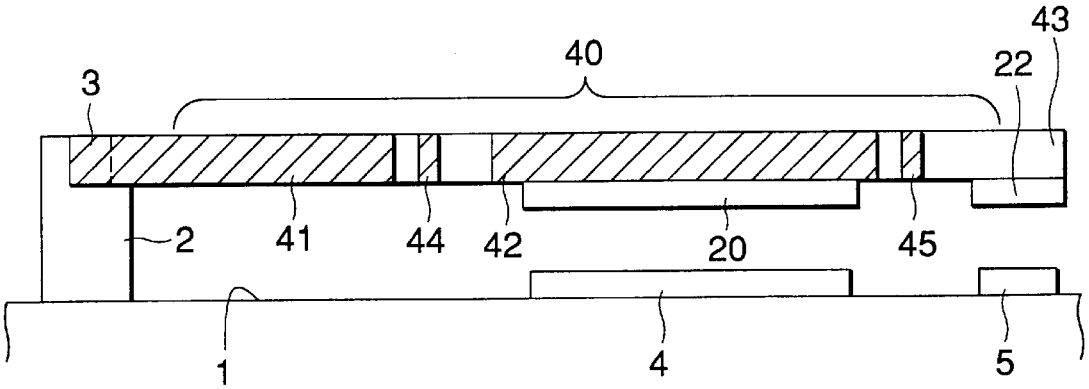
FIG. 10 is a side cross sectional view taken along line X—X shown in FIG. 9.
Figure 11:
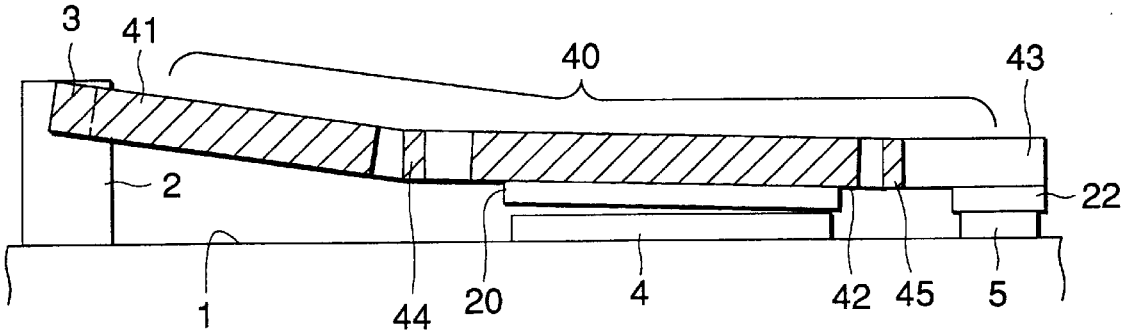
FIG. 11 is a side cross sectional view showing a state in which the operation for turning the contacts on has been completed in the third embodiment.

FIGS. 9 to 11 show a third embodiment of the present invention. The elastic connection portion is formed between the movable electrode and a movable contact in the movable structure portion which constitutes the relay structure. Moreover, the elastic connection portion is also formed between the fulcrum of rotation (a center of torsion of the torsional elasticity portion in the form of the beam shape) of the movable structure portion and the movable electrode. Referring to the drawings, a movable structure portion 40 constituting a relay structure is held such that a gap is maintained from an insulating substrate 1 through an anchor structure 2 by an elastic torsional portion 3 in the form of the beam shape. The movable structure portion 40 incorporates a beam support portion 41 having a predetermined length and formed into the beam shape, a movable-electrode support portion 42, a movable-contact support portion 43, a first elastic connection portion 44 for connecting the leading end of the beam support portion 41 and the movable-electrode support portion 42 to each other and a second elastic connection portion 45 for connecting the movable-electrode support portion 42 and the movable-contact support portion 43 to each other. The first and second elastic connection portions 44 and 45 are torsional elasticity portions in the form of the beam shape. The movable-electrode support portion 42 is supported rotatively with respect to the leading end of the beam support portion 41 in the form of the beam shape by the first elastic connection portion 44. The movable-contact support portion 43 is rotatively supported with respect to the leading end of the movable-electrode support portion 42 by the second elastic connection portion 45.

The other structures are similar to those according to the foregoing first embodiment and the same or similar portions are given the same reference numerals and they are omitted from description.

FIGS. 10 and 11 show the operation of the electrostatic relay according to the third embodiment. FIG. 10 shows the positions of electrodes and contacts in a non-operation state (in a state in which no voltage is applied). When voltage is applied between the fixed electrode 4 and the movable electrode constituting the electrostatic actuator, electrostatic attractive force is generated between the two electrodes. Thus, as shown in FIG. 11, the movable structure portion 40 which is the relay structure causes the movable contact 22 to be brought into contact with the fixed contact 5 by dint of the torsional elasticity deformation of the elastic torsional portion 3 in the form of the beam shape. Moreover, the torsional elasticity deformation of the first and second elastic connection portions 44 and 45 causes rotation to be performed until the movable contact 22 and the fixed contact 5 are brought into close contact with each other in a parallel state.

As can be understood from FIG. 11, an appropriate elastic modulus of each of the first and second elastic connection portions 44 and 45 which are torsional elasticity portions is employed in the third embodiment. Thus, the movable electrode 20 and the fixed electrode 4 can be brought to opposite positions such that the movable electrode 20 and the fixed electrode 4 of the electrostatic actuator are made to be substantially in parallel with each other and an air gap is maintained. Thus, larger electrostatic attractive force can be obtained as compared with the structure in which the wedge shape air gap is provided as shown in FIG. 3. Moreover, contact between the movable electrode 20 and the fixed electrode 4 can completely be prevented. Therefore, no insulating layer is required on the movable electrode 20 or the fixed electrode 4 for constituting the electrostatic actuator. As an alternative to this, the insulating pressure resistance can be lowered. In addition, a problem in that the electrodes of the actuator when the electrodes are undesirably brought into contact with each other can be prevented.

Fourth Embodiment

Figure 12:
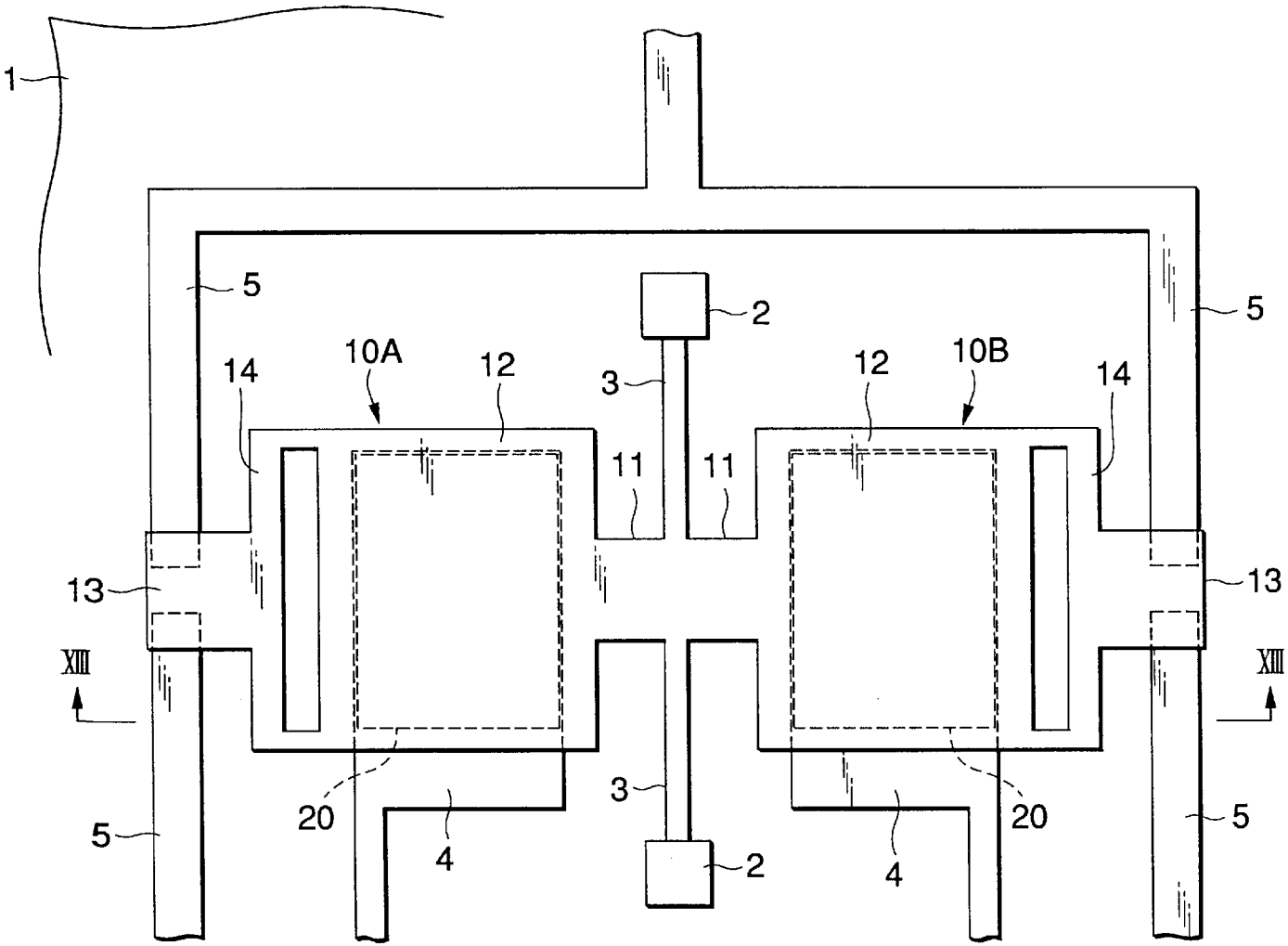
FIG. 12 is a plan view showing a fourth embodiment of the present invention.
Figure 13:
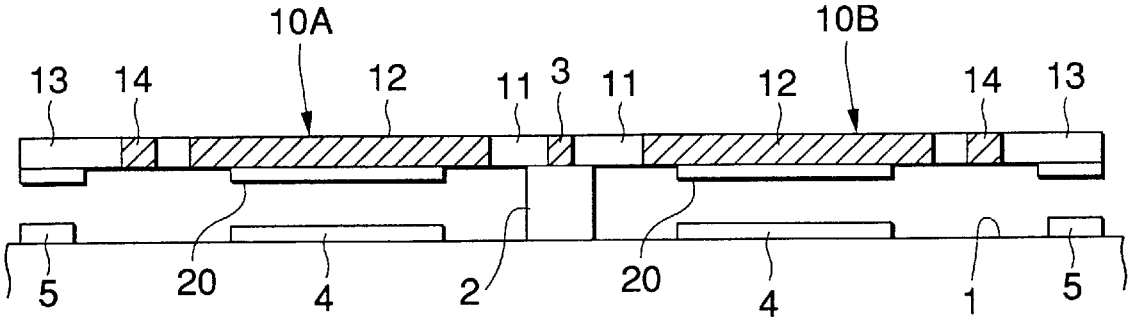
FIG. 13 is a cross sectional view taken along line XIII—XIII shown in FIG. 12.

FIGS. 12 and 13 show a fourth embodiment of the present invention. In this embodiment, the relay structure is extended from the substrate to the two sides of the torsional elasticity portion in the form of the beam shape which rotatively supports the relay structure. Moreover, the relay structure is disposed symmetrically with respect to the torsional elasticity portion in the form of the beam shape. That is, the electrostatic relay according to the fourth embodiment incorporates an insulating substrate 1, an anchor structure 2 stood erect on the substrate 1 and secured to the same, an elastic torsional portion 3 held such that a gap is maintained from the substrate 1 by the anchor structure 2 and formed into the beam shape and movable structure portions 10A and 10B rotatively disposed on the two sides by dint of the elastic support performed by the elastic torsional portion 3 and constituting the relay structure. Electrode and contacts of the movable structure portions 10A and 10B are similar to those according to the first embodiment. Therefore, the same or similar elements are given the same reference numerals and they are omitted from description.

Figure 14:
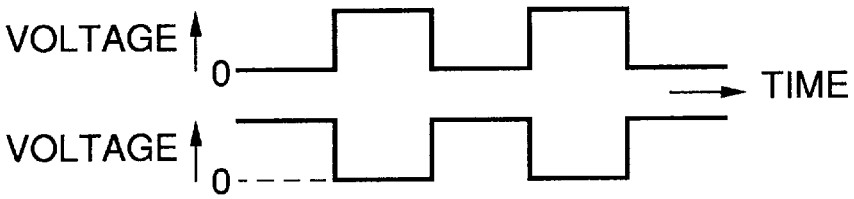
FIG. 14 is a waveform graph showing waveform of voltage which is applied between electrodes of a pair of electrostatic actuators according to the fourth embodiment.

According to the fourth embodiment, inverse output voltage as shown in FIG. 14 is applied between the electrodes 4 and 20 of the right and left electrostatic actuators when the electrostatic relay is operated. Thus, when either of the relay contact 5 or 22 is turned off, the operation for separating the contacts can be performed also by the electrostatic attractive force of the opposite electrostatic actuator as well as the restoring operation by dint of the elasticity of the elastic torsional portion 3 in the form of the beam shape. Thus, the relay contact can reliably be turned off.

Figure 15:
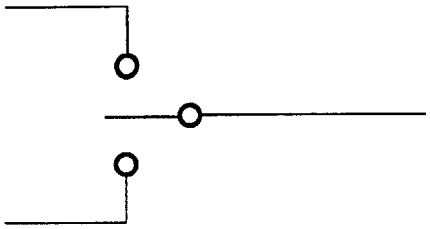
FIG. 15 is a circuit diagramshowing a structure in which a switch is formed in the fourth embodiment.

If either of the electrode of the right and left fixed contacts is commonly connected as shown in FIG. 12, the switch can easily be constituted as shown in FIG. 15.

Another structure may be employed in which a pair of the movable contact 22 of either of the movable structure portion 10A or 10B and an opposite fixed contact 5 adjacent to the substrate is omitted. Thus, the reliability in the turning off operation can be improved.

In the above-mentioned embodiments, the movable electrode which is either of the electrodes of the electrostatic actuator is formed on the surface of the relay structure (the movable structure portion) adjacent to the substrate. The position of the electrode is not limited to the foregoing position. The substantial necessity lies in that the electrostatic attractive force can be generated between the fixed electrode and the movable electrode. If the structure of the electrostatic actuator, that is, the relay structure is made of an insulating material having a high dielectric constant or a material having high resistance, the movable electrode may be disposed on the surface of the relay structure adjacent to the substrate. If the foregoing structure is made of a conductive material, the foregoing structure may be the movable electrode.

The movable contact 22 disposed at the end of the relay structure (the movable structure portion) is not limited to one. A plurality of the movable contacts 22 may be provided.

The present invention will furthermore specifically be described such that examples will now be described.

Figure 16:
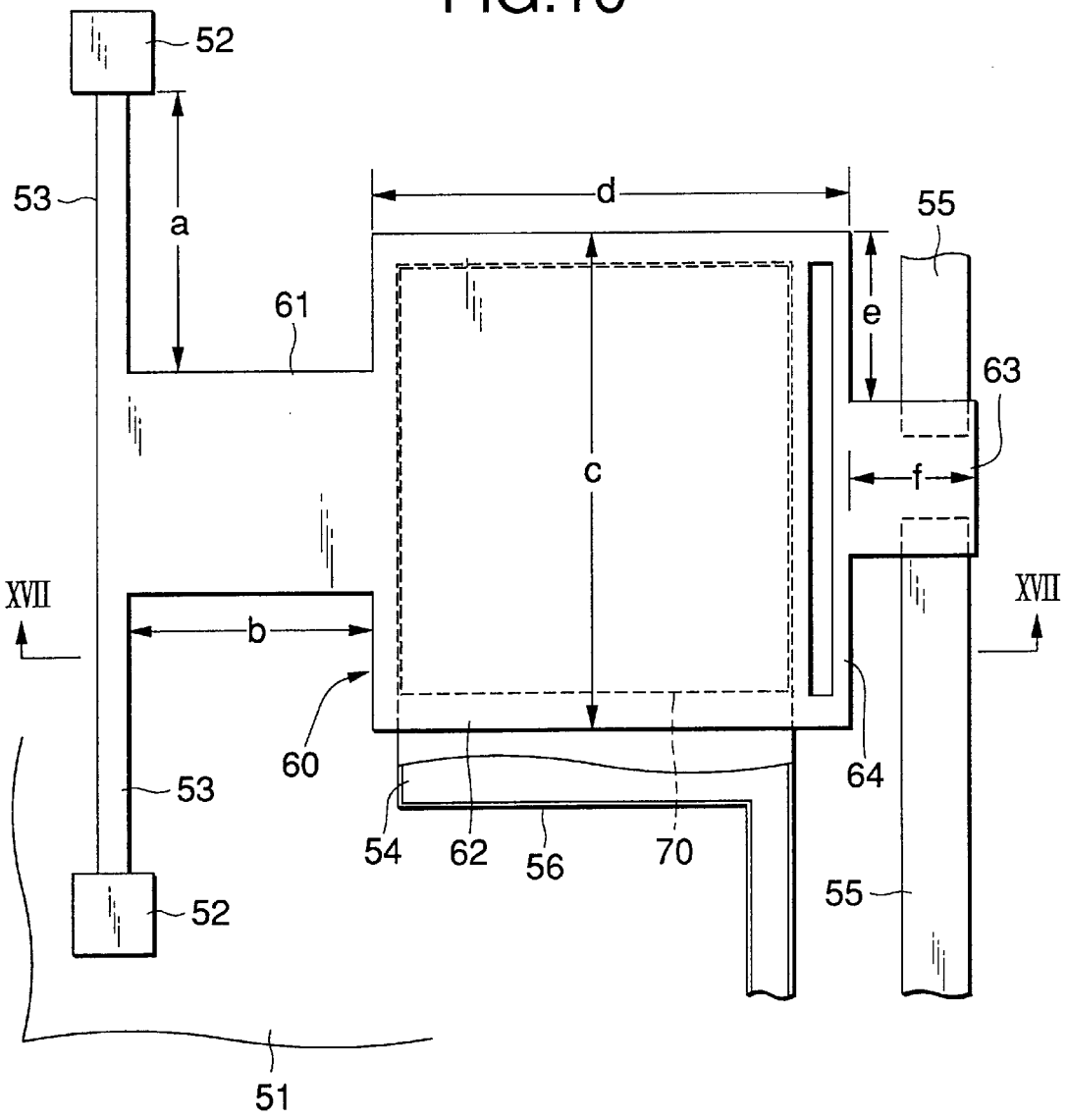
FIG. 16 is a plan view showing the embodiment of the present invention.
Figure 17:
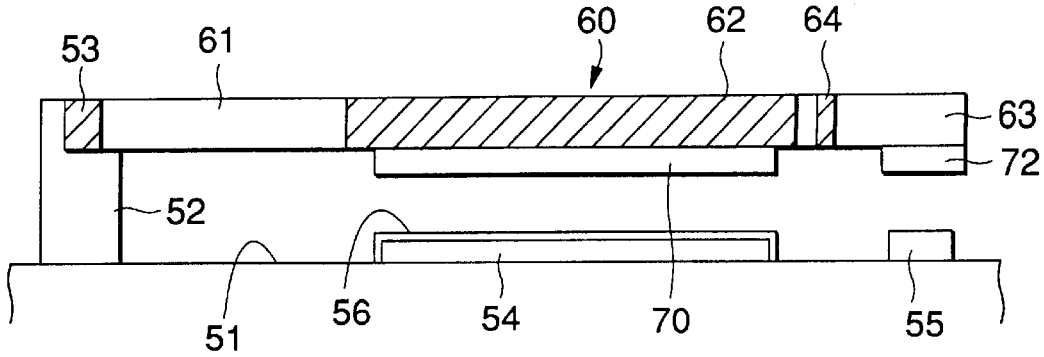
FIG. 17 is a cross sectional view taken along line XVII—XVII shown in FIG. 16.
Figure 18A:
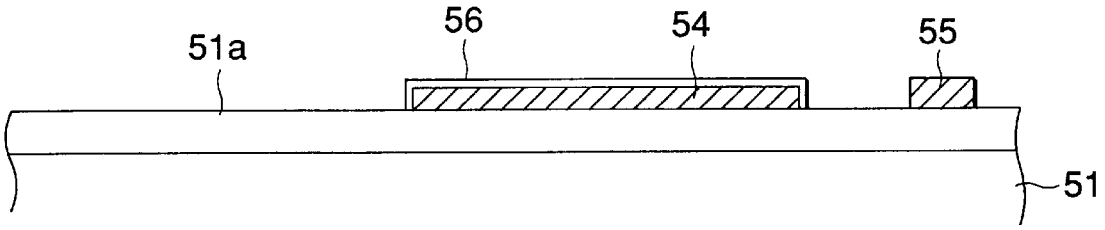
FIGS. 18A to 18C are diagrams showing a process for manufacturing the electrostatic relay according to the embodiment of the present invention.

FIGS. 16 and 17 are a plan view and a side view of the electrostatic relay according to this example. In this example, a single crystal Si plate 51 having a SiO2 insulating layer 51*a* having a thickness of about 1 μm and formed by a thermal oxidation method as shown in FIG. 18A was used as the substrate. Then, Au having a thickness of about 500 nm was formed on the overall surface of the substrate by a sputtering method. Then, a photoetching method was employed so that a fixed electrode 54 of the electrostatic actuator and a fixed contact 55 of the relay were patterned. Then, a reactive sputtering method was employed to form a SiN insulating layer having a thickness of about 100 nm on the overall surface of the substrate. Similarly, the photoetching method was employed to selectively remove the foregoing insulating layer such that the surface of the fixed electrode 54 of the electrostatic actuator was left. Thus, an insulating layer 56 was formed.

Figure 18B:
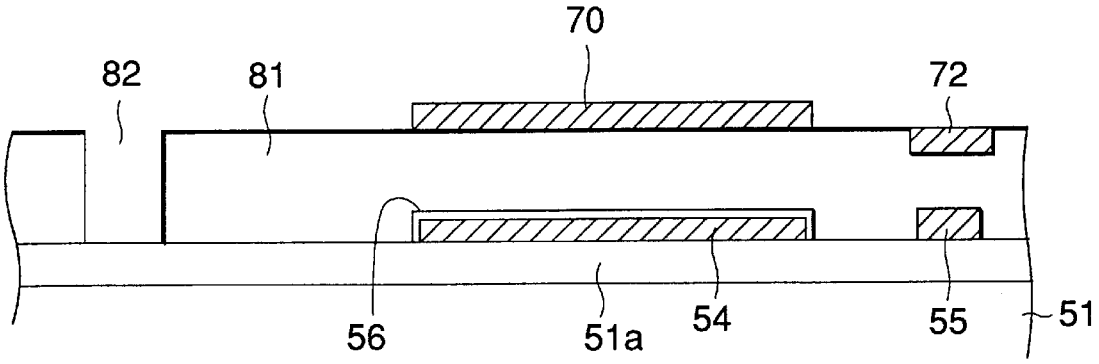

Then, a vacuum CVD method was employed as shown in FIG. 18B so that a SiO2 film which was formed into a sacrifice layer 81 was deposited on the overall surface of the substrate such that the thickness of the SiO2 film was about 3 μm. Subsequently, a RIE method is employed to selectively etch a part of SiO2 film corresponding to the movable contact 72 by approximately 500 nm. Then, an Au film having a thickness of about 500 nm was formed on the overall surface of the substrate together with a SiN reaction preventive layer having a thickness of about 20 nm. Then, patterning into predetermined shapes was performed by photoetching so that a movable electrode 70 of the electrostatic actuator and a movable contact 72 of the relay were formed. Then, a portion 82 of the sacrifice layer 81 corresponding to the anchor structure 52 in the form of the SiO2 film was selectively removed by using photoetching.

Figure 18C:
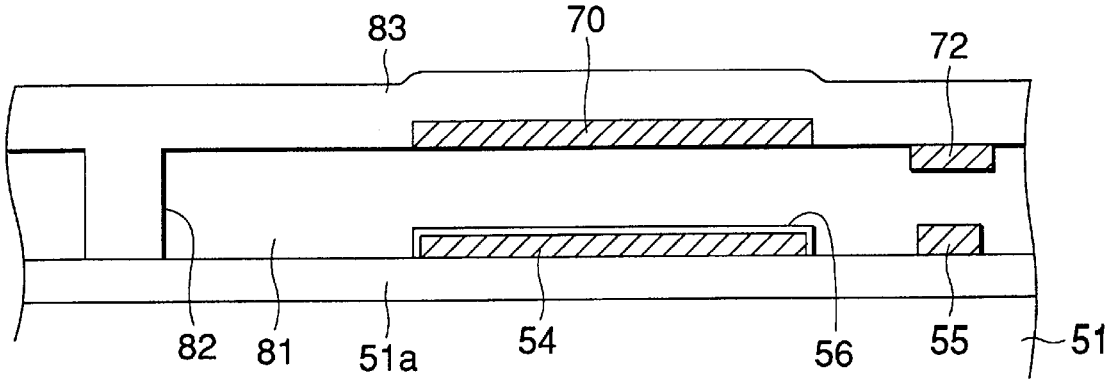

Finally, the vacuum CVD method was employed to form a polycrystal Si film 83 on the overall surface of the substrate to have a thickness of about 4 μm, as shown in FIG. 18C, and then patterned into the shape of the relay structure to be described later by using a RIE method.

Then, the SiO2 film of the sacrifice layer 81 was selectively etched by HF so that a movable structure portion 60 which is formed into the relay structure as shown in FIGS. 16 and 17 was obtained by releasing.

The torsional elastic portion 53 in the form of the beam shape has a length a from the anchor structure 52 which was about 100 μm and a width of about 6 μm. The movable structure portion 60 constituting the relay structure incorporates a beam connection portion 61 having a length b of about 100 μm and in the form of the beam shape, a movable-electrode support portion 62 having a width c and a length d of about 200 μm, a torsional elasticity connection portion 64 having a width of about 6 μm and a length e of about 50 μm and formed into the beam shape and a movable-contact support portion 63 having a length f of about 50 μm. The overall body of the movable structure portion 60 can be rotated by torsional elasticity of the torsional elastic portion 53 formed into the beam shape. Moreover, the movable-contact support portion 63 can be rotated by the torsional elasticity of the elastic connection portion 64 formed into the beam shape.

When operating voltage of about not higher than 20 V was applied between the electrodes 54 and 70 constituting the electrostatic actuator of the electrostatic relay according to the present invention, the contacts 55 and 72 are closed. At this time, the contact resistance was about 0.2 Ω. Thus, a 100 mA or higher contact electric current could be passed. The foregoing value is a satisfactorily practical value for a relay for a small signal. For example, the shape and dimensions are changed such that the thickness of the SiO2 film which is formed into the sacrifice layer can be reduced and the areas of the electrodes of the electrostatic actuator can be enlarged. Thus, the operation can be performed with lower voltage.

As a comparative example, a conventional structure was manufactured which had a similar basic structure and which was not provided with the elastic connection portion for elastically supporting the movable-contact support portion.

The comparative example was evaluated. As a result, although the operating voltage was about not higher than 20 V, high contact resistance of 5 Ω to 10 Ω was realized. To lower the contact resistance to 1 Ω or lower, an operating voltage of 50 V or higher was required. When a contact electric current of several mA was passed, the contacts were melted and fixed. Thus, the operation for turning the structure off was impossible.

As can be understood from the foregoing description, the electrostatic relay according to the present invention is able to easily manufacture a practical electrostatic relay exhibiting low voltage operation, low contact resistance and a large contact capacity which have been impossible for the conventional structure.

Although this example has the structure that the thin film forming technique is employed to form the movable structure portion which is the relay structure. The method of forming the electrostatic relay according to the present invention is not limited to the foregoing structure. For example, the movable structure portion may be formed such that the movable contact and the movable electrode are formed on a single crystal Si substrate. Moreover, an anisotropic etching technique or the like is employed to realize a required shape so as to be bonded to an insulating substrate similarly having a fixed contact and a fixed electrode through a spacer. Also in the above-mentioned case, an electrostatic relay can easily be obtained which exhibits low voltage operation and a large contact capacity.

As the movable structure portion serving as the relay structure, a thin metal plate having a surface subjected to an insulating process may be employed. The electrostatic relay manufactured by the above-mentioned method can be applied to a purpose in which a higher contact electric current is passed as compared with the electrostatic relay manufactured by the thin film forming technique.

Although the invention has been described in its preferred form, it is understood that the present disclosure of the preferred form can be changed in the details of construction and in the combination and arrangement of parts without departing from the spirit and the scope of the invention as hereinafter claimed.

As described above, the electrostatic relay according to the present invention is able to overcome the problems experienced with the conventional electrostatic relay in that insufficiently small contact electric current capacity and rise in the contact resistance cannot be overcome. According to the present invention, the contacts can be brought into plane contact with each other. Thus, a large contact capacity and low contact resistance can be realized.

Moreover, the problems-experienced with the conventional structure in that the distance between the electrodes constituting the electrostatic actuator cannot sufficiently be shortened when the operation is performed and thus the contact pressure is insufficiently low, the contact resistance rises and the operating voltage is raised to overcome the foregoing problems can be overcome by the structure of the present invention. Since the distance between the electrodes can considerably be shortened as compared with the conventional structure, sufficiently high contact pressure and low contact resistance can be realized with the operating voltage lower than that required for the conventional structure.

As a result of the significant improvement in the relay characteristics, the present invention is able to realize a practical electrostatic relay as compared with the conventional electrostatic relay.

Fifth Embodiment

Embodiments of an electrostatic relay according to second aspect of the present invention will now be described with reference to the drawings.

Figure 19:
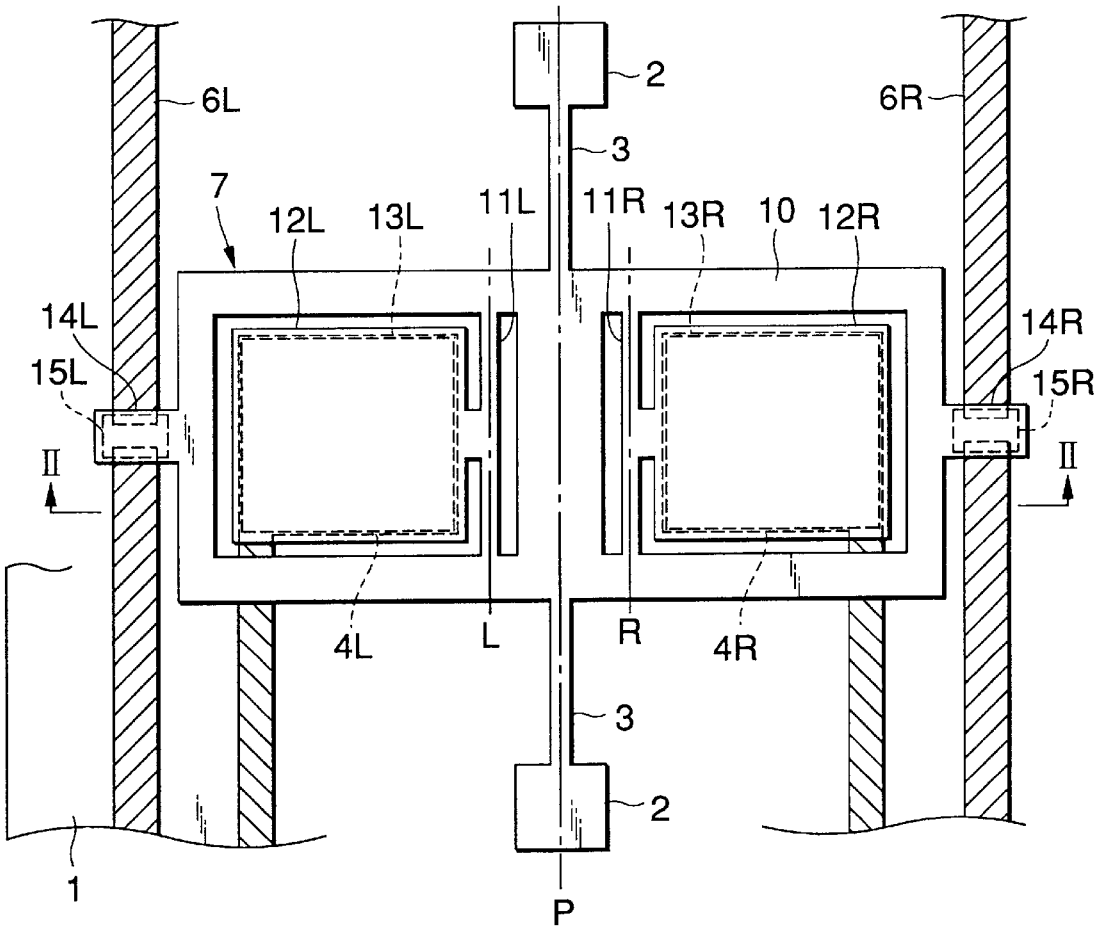
FIG. 19 is a plan view showing a fifth embodiment of an electrostatic relay according to the present invention.

FIGS. 19 to 25 show a fifth embodiment of an electrostatic relay according to the present invention. FIG. 19 is a plan view. FIGS. 20 to 25 are front cross sectional views showing the operation. Referring to the drawings, the electrostatic relay incorporates an insulating substrate 1, an anchor structure 2 stood erect on the substrate 1 and secured to the same, an elastic torsional portion 3 held such that a gap is maintained from the substrate 1 and formed into a beam shape and a relay structure 7 which is able to rotate (revolve) by dint of elastic support by the elastic torsional portion 3. As a result of the above-mentioned structure, the relay structure 7 is rotatively held such that the elastic torsional portion 3 serves as rotation fulcrum P. Since the relay structure 7 intersects the elastic torsional portion 3 so as to be formed into a seesaw structure extending to the two sides of the rotation fulcrum P, the relay structure 7 is able to perform a seesaw motion.

The insulating substrate 1 has a structure that at least the surface thereof is subjected to an insulating process. For example, the substrate 1 is a single crystal Si substrate having a SiO2 insulating layer formed on the surface thereof. The three elements, which are the anchor structure 2, the elastic torsional portion 3 in the form of the beam shape and the relay structure 7, are integrally formed by polycrystal Si or the like.

The relay structure 7 has a movable structure portion (a main body of the relay structure) 10 arranged to perform a seesaw operation and having required rigidity. In the left-hand portion of the relay structure 7, an elastic torsional portion 11L in the form of the beam shape serving as an elastic connection portion is formed. Moreover, a movable-electrode support portion 12L (a movable electrode portion for which a movable electrode is provided) connected to a movable structure portion 10 through the elastic torsional portion 11L is formed. In a right-hand portion which is symmetrical with respect to the rotation fulcrum P of the movable structure portion 10, an elastic torsional portion 11R in the form of the beam shape and a movable-electrode support portion 12R (a movable electrode portion for which a movable electrode is provided) are formed. The elastic torsional portions 11L and 11R in the form of the beam shape rotatively (in a revolving permitted manner) support the movable-electrode support portions 12L and 12R. The elastic torsional portions 11L and 11R in the form of the beam shape are formed adjacent to the rotation fulcrum P of the movable structure portion 10, while the movable ends of the movable-electrode support portions 12L and 12R are formed apart from the rotation fulcrum P of the movable structure portion 10. The positions of elastic torsional portions 11L and 11R in the form of the beam shape are rotation fulcrums L and R of the movable-electrode support portions 12L and 12R. The torsional elastic modulus of each of the elastic torsional portions 11L and 11R in the form of the beam shape is made to be smaller than that of the elastic torsional portion 3 in the form of the beam shape. That is, the movable-electrode support portions 12L and 12R can be rotated with relatively small force as compared with the movable structure portion 10.

Figure 20:
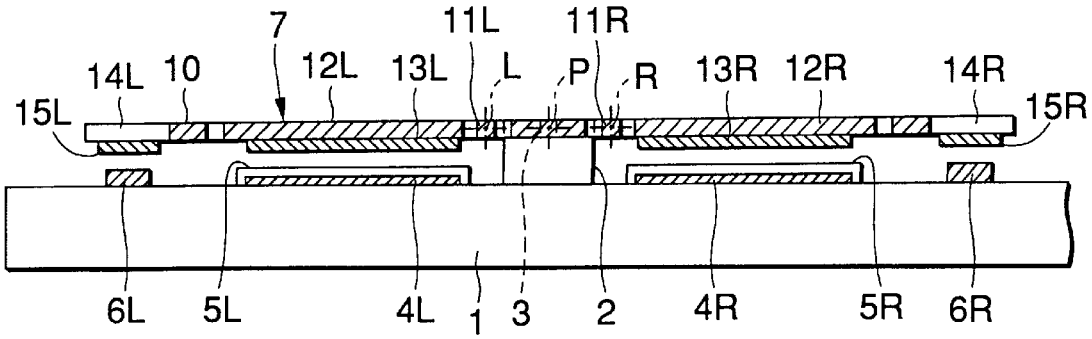
FIG. 20 is a front cross sectional view taken along line II—II shown in FIG. 19.

Movable electrodes 13L and 13R are provided for the movable-electrode support portions 12L and 12R at positions opposite to the substrate 1. Fixed electrodes 4L and 4R are formed on the substrate 1 at positions opposite to the corresponding movable electrodes. As shown in FIG. 20, insulating layers (dielectric layers) 5L and 5R covering the surfaces of the fixed electrodes are formed.

Movable-contact support portions 14L and 14R are integrally formed at two ends of the movable structure portion 10 which is the main body of the relay structure 7. Movable contacts 15L and 15R are provided for the surfaces of the movable-contact support portions 14L and 14R opposite to the substrate. Fixed contacts 6L and 6R are fixed to the surface of the substrate 1 at positions opposite to the corresponding movable contacts.

The fixed electrodes 4L and 4R secured to the surface of the insulating substrate 1 and the movable electrodes 13L and 13R secured to the movable-electrode support portions 12L and 12R constitute an electrostatic actuator for generating electrostatic attractive force by dint of voltage applied between the movable electrodes 13L and 13R secured to the movable-electrode support portions 12L and 12R. The fixed electrodes 4L and 4R and the movable electrodes 13L and 13R are connected to an outer power source through electric wires (not shown).

The principle of the operation of the electrostatic relay according to the fifth embodiment will now be described. Initially, the operation for closing the relay contact will now be described.

Figure 21:
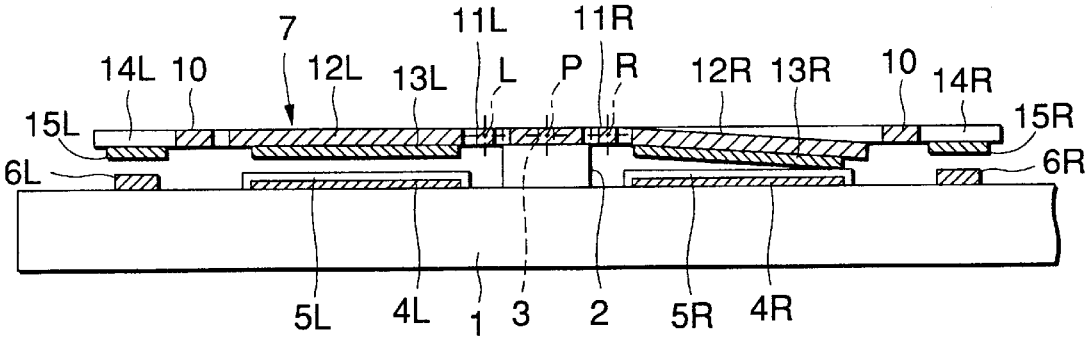
Figure 22:
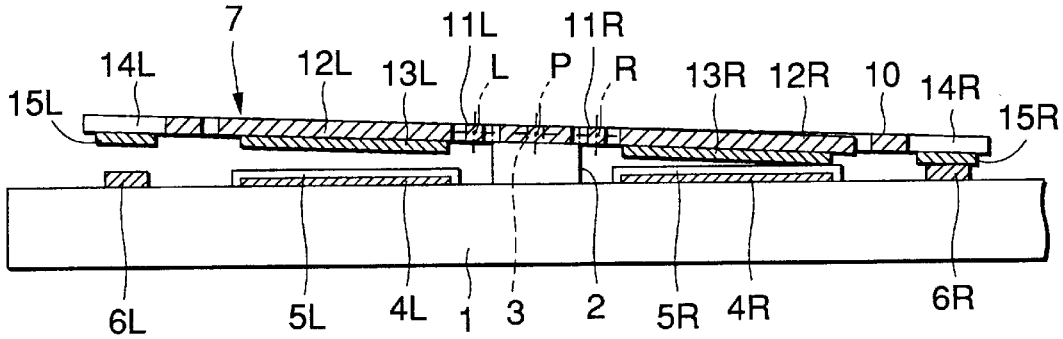
FIG. 22 is a front cross sectional view showing a state in which the operation for turning the contacts according to the fifth embodiment on has been completed.

FIG. 20 shows the positions of the electrodes and the contacts in a non-operation state (in a state where no voltage is applied). In the foregoing state, the fixed contacts 6L and 6R and the movable contacts 15L and 15R are opened. When voltage is applied between the fixed electrode 4R and the movable electrode 13R constituting the right-hand electrostatic actuator, electrostatic attractive force is generated between the two electrodes. Thus, the movable-electrode support portion 12R is rotated around the rotation fulcrum R by dint of the torsional elasticity of the elastic torsional portion 11R in the form of the beam shape. As a result, the movable-electrode support portion 12R is deformed to a contact position of the substrate 1 as shown in FIG. 21 (the movable electrode 13R is deformed until it is brought into contact with the insulating layer 5R covering the fixed electrode 4R). The electrostatic attractive force acting between the fixed electrode and the movable electrode of the electrostatic actuator is in proportion to the inverse square of the distance. Therefore, as can be understood also from FIG. 21, considerably great electrostatic attractive force is generated between the fixed electrode 4R and the movable electrode 13R disposed such that their distance has been shortened to have a wedge shape air gap. As shown in FIG. 22, the movable structure portion 10 which is the main body of the relay structure 7 is rotated to the right such that the rotation fulcrum P serves as the center of rotation. Thus, the movable contact 15R and the fixed contact 6R are brought into contact with each other so that the relay contact is closed.

In a state in which the relay contact has been closed, the wedges shape air gap between the movable electrode 13R and the fixed electrode 4R is narrowed, as shown in FIG. 22. Thus, a high contact pressure can be obtained.

As described above, the electrostatic relay according to the fifth embodiment of the present invention has the structure that the movable-electrode support portion 12R which is rotated with small force is operated in an initial stage of application of the voltage to the electrostatic actuator in which the electrodes of the electrostatic actuator are distant from each other and the electrostatic attractive force is small. Thus, the distance between the electrodes is shortened. The shortened distance between the electrodes causes considerable large force to be generated between the electrodes of the electrostatic actuator. The large force rotates the main body of the relay structure 7, that is, the movable structure portion 10 which is the outer frame portion of the movable-electrode support portion around the rotation fulcrum P. Thus, the relay contact is closed and a higher pressure can be applied between the contacts.

Therefore, when the electrostatic relay is used at the same operating voltage as that of the conventional electrostatic relay, the contact resistance can be lowered. Since larger force can be obtained when the contacts are closed, the elastic modulus of the elastic torsional portion 3 in the form of the beam shape for supporting the relay structure 7 can furthermore be enlarged. Therefore, if fixing of the contacts takes place, the contacts can easily be separated from each other.

That is, when the same voltage is used to operate the electrostatic relay according to this embodiment as that of the conventional electrostatic relay, breakdowns of a type fixing of the contacts can be prevented. Thus, a higher contact electric current can be passed. If the contact capacity is the same as that of the conventional electrostatic relay, the operation can be permitted with lower operating voltage.

The operation for opening the relay contact will now be described.

Figure 23:
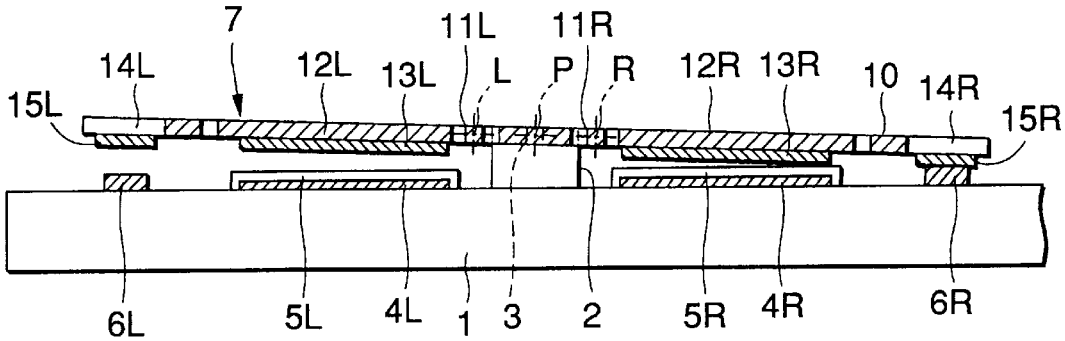
FIG. 23 is a front cross sectional view showing a state in which the voltage applied to the electrostatic relay has been made to be zero after the contacts have been turned on in the structure according to the fifth embodiment.

FIG. 23 shows a state in which the electrodes of the right-hand electrostatic actuator are short-circuited (the same potential) and the electrostatic attractive force on the right-hand side has been made to be zero after the relay contact shown in FIG. 22 has been actuated. In the above-mentioned state, the force for separating the contacts 6R and 15R from each other is only the restoring force caused from the elastic modulus of the elastic torsional portion 3 in the form of the beam shape which elastically supports the movable structure portion 10 which is the main body of the relay structure 7.

If the force for fixing the contacts 6R and 15R is larger than the foregoing restoring force, the contacts of the electrostatic relay are not opened. Thus, a failure of a type that the contacts are fixed takes place.

The conventional electrostatic relay may be formed such that voltage is applied between the electrode of the left-hand electrostatic actuator so as to cause the relay structure to perform the seesaw operation so that the force for separating the right-hand contact is generated.

However, as can be understood from FIG. 23, the movable structure portion 10 of the movable electrode 13L of the left-hand electrostatic actuator is inclined. Thus, the movable electrode 13L is greatly distant from the fixed electrode 4L as compared with the non-operation state shown in FIG. 20. Therefore, satisfactorily large electrostatic attractive force cannot be generated. As a result, sufficiently large force for separating the right-hand contacts 6R and 15R cannot be generated.

Figure 24:
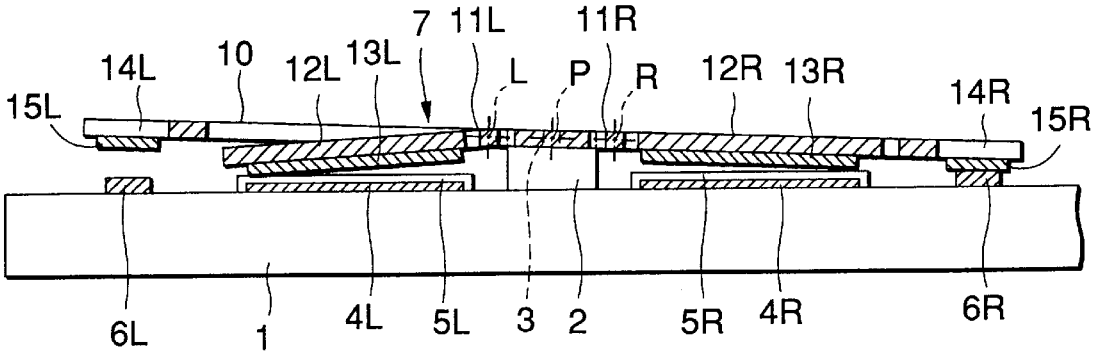
FIG. 24 is a front cross sectional view showing an intermediate state according to the fifth embodiment in which the contacts are being turned off.

In the fifth embodiment of the present invention, when voltage is applied between the movable electrode 13L and the fixed electrode 4L of the left-hand electrostatic actuator in the state shown in FIG. 23, the movable-electrode support portion 12L which can be rotated with small force is rotated such that the rotation fulcrum L serves as the center of rotation, as shown in FIG. 24. Thus, the movable-electrode support portion 12L is deformed to the position of contact with the substrate 1 (deformed until the movable electrode 13L is brought into contact with the insulating layer 5L covering the fixed electrode 4L)

The electrostatic attractive force acing between the fixed electrode and the movable electrode of the electrostatic actuator is inverse proportion to the square of the distance. Therefore, a considerably great electrostatic attractive force is generated between the movable electrode 13L and the fixed electrode 4L, the distance between which has been shortened in the form of the wedge shape air gap. Thus, great attractive force is generated for narrowing the wedge shape air gap.

Figure 25:
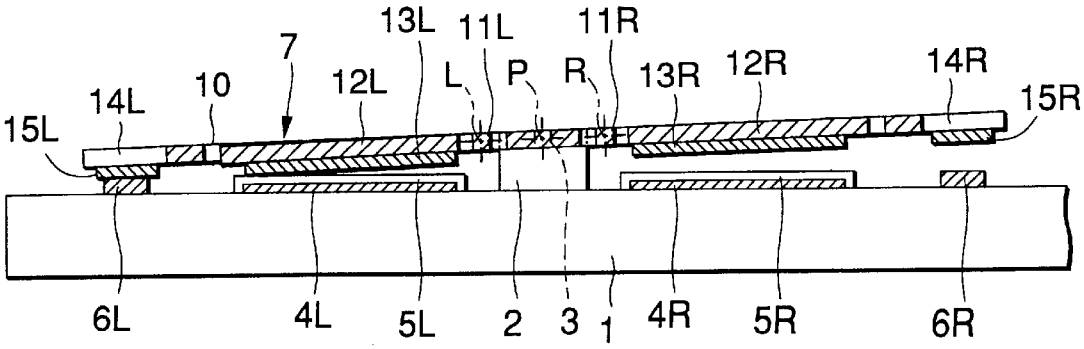
FIG. 25 is a front cross sectional view showing a state according to the fifth embodiment in which the operation for turning the contacts off has been completed.

The great electrostatic attractive force rotates the movable structure portion 10 which is the main body of the relay structure 7 to the left with large force. Thus, the right-hand movable contact 15R and the fixed contact 6R which have been fixed to each other can be separated from each other with large force, as shown in FIG. 25.

According to the fifth embodiment, the following effects can be obtained.

The movable-electrode support portions 12L and 12R provided for the movable structure portion 10 at the positions on the two sides of the rotation fulcrum P are rotatively connected to the movable structure portion 10 by dint of the elastic torsional portions 11L and 11R serving as the elastic connection portions and formed in the beam shape. When voltage is applied between either of the right-hand or left-hand fixed electrode and the movable electrode to operate the right-hand or left-hand electrostatic actuator, the movable-electrode support portion approaches the substrate so that the distance between the fixed electrode and the movable electrode is shortened. Therefore, even low voltage is sufficient to turn the relay contact on with a sufficiently high contact pressure.

When the relay contact is turned off, application of voltage to the electrostatic actuator opposite to a melted contact enables great separating force to be generated as compared with the conventional electrostatic relay even if the contacts encounter the phenomenon of melting. Thus, the failure of the type that the contacts are melted can be prevented.

Since the fixed electrodes 4L and 4R are covered with the insulating layers 5L and 5R, a problem of short circuit such that the fixed electrodes 4L and 4R are brought into directly contact with the movable electrodes 13L and 13R can reliably be prevented. Although the insulating layers 5L and 5R are interposed between the fixed electrodes 4L and 4R and the movable electrodes 13L and 13R, the insulating layers 5L and 5R are made of the dielectric materials having a larger dielectric constant as compared with that of air. Therefore, reduction in the electrostatic attractive force by dint of existence of the insulating layers 5L and 5R is not required to be considered (can be ignored).

As a result, a practical electrostatic relay can be realize which exhibits a low-voltage operation, low contact resistance and a large contact capacity.

Sixth Embodiment

Figure 26:
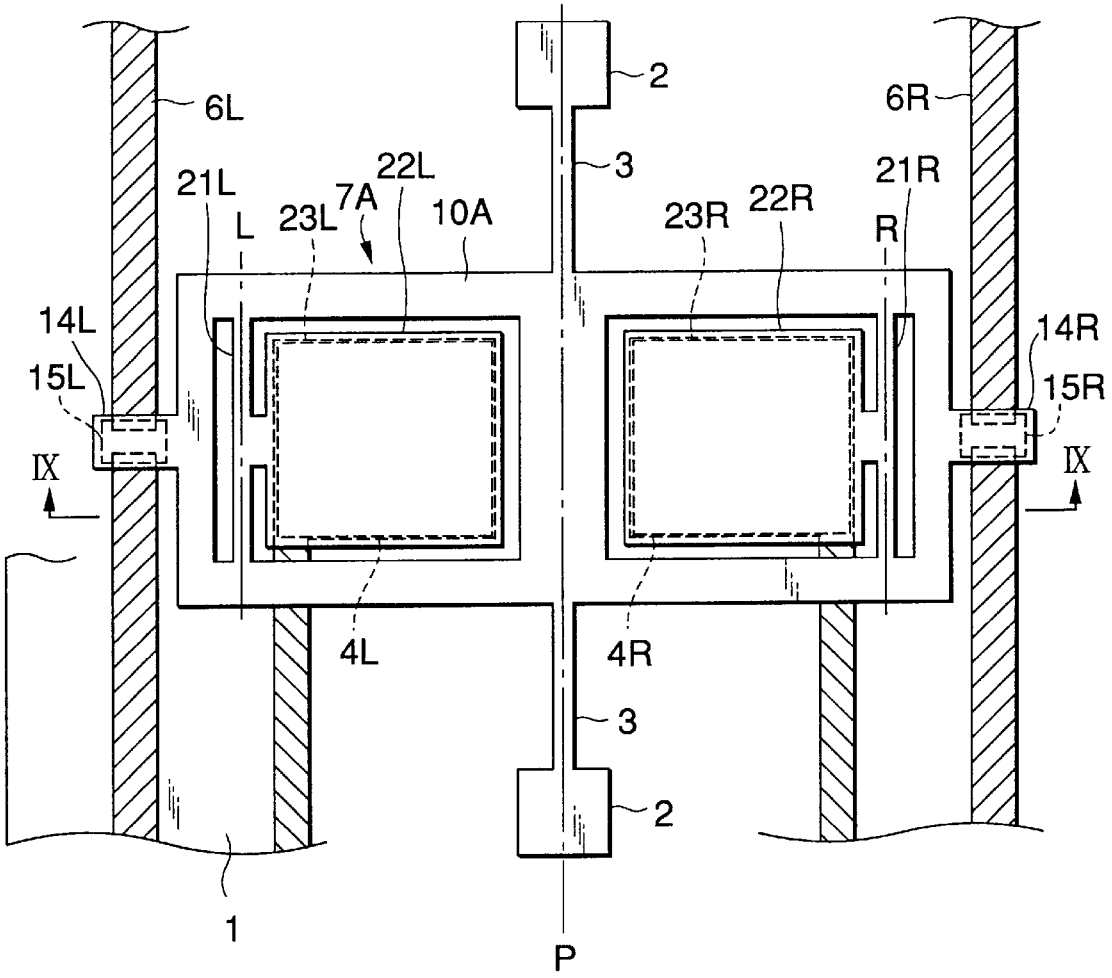
FIG. 26 is a plan view showing a sixth embodiment of the electrostatic relay according to the present invention.

FIGS. 26 to 32 show a sixth embodiment of the electrostatic relay according to the present invention. FIG. 26 is a plan view. FIGS. 27 to 32 are front cross sectional views showing the operation. Referring to the drawings, a relay structure 7A has, on the left-hand portion thereof, elastic torsional portion 21L serving as an elastic connection portion and formed into the beam shape and a movable-electrode support portion 22L connected to a movable structure portion 10A (the main body of the relay structure 7A) through the elastic torsional portion 21L. Moreover, an elastic torsional portion 21R in the form of the beam shape and a movable-electrode support portion 22R are formed on the right-hand portion symmetrical with respect to the rotation fulcrum P of the movable structure portion 10A which is the main body of the relay structure 7A. The elastic torsional portions 21L and 21R in the form of the beam shape rotatively support the movable-electrode support portions 22L and 22R. However, this embodiment is different from the fifth embodiment in that the elastic torsional portions 21L and 21R in the form of the beam shape are formed adjacent to the two ends of the movable structure portion 10A. The movable ends of the movable-electrode support portions 22L and 22R are positioned adjacent to the rotation fulcrum P. The positions of the elastic torsional portions 21L and 21R in the form of the relay are the rotation fulcrums L and R of the movable-electrode support portions 22L and 22R. The elastic modulus of each of the elastic torsional portions 21L and 21R in the form of the beam shape is made to be not larger than that of the elastic torsional portion 3 in the form of the beam shape. That is, the movable-electrode support portions 22L and 22R can be rotated with the force which is not larger than that required for rotating the movable structure portion 10A.

Movable electrodes 23L and 23R are provided for the movable-electrode support portions 22L and 22R at positions opposite to the substrate 1. Fixed electrodes 4L and 4R are secured to the surface of the substrate 1 at positions opposite to the movable electrodes. Insulating layers (dielectric layers) 5L and 5R covering the surfaces of the fixed electrodes are formed. Movable contacts 15L and 15R are provided for the surfaces of the movable-contact support portions 14L and 14R at the two ends of the movable structure portion 10A opposite to the substrate. Fixed contacts 6L and 6R are secured to the surface of the substrate 1 at positions opposite to the corresponding movable contacts. Since the other portions are similar to those according to the fifth embodiment, the same and corresponding portions are given the same reference numerals and they are omitted from description.

The principle of the operation of the electrostatic relay according to the sixth embodiment will now be described. Initially, the operation for closing the relay contact will now be described.

Figure 27:
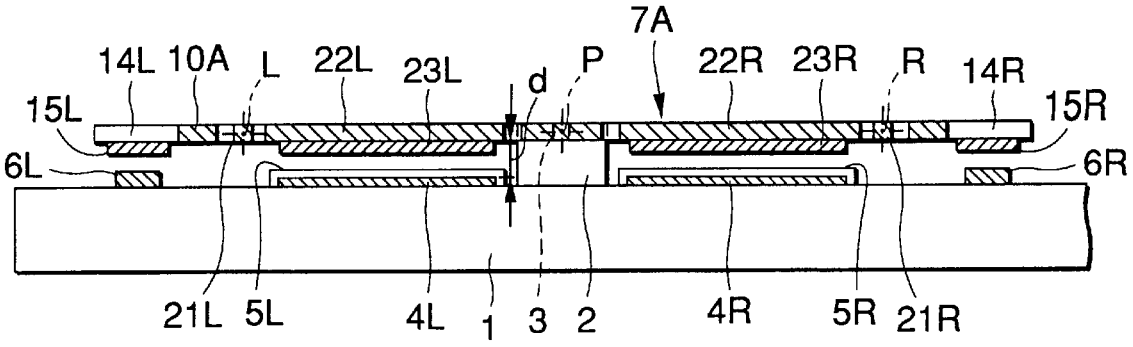
FIG. 27 is a front cross sectional view taken along line IX—IX shown in FIG. 26.
Figure 28:
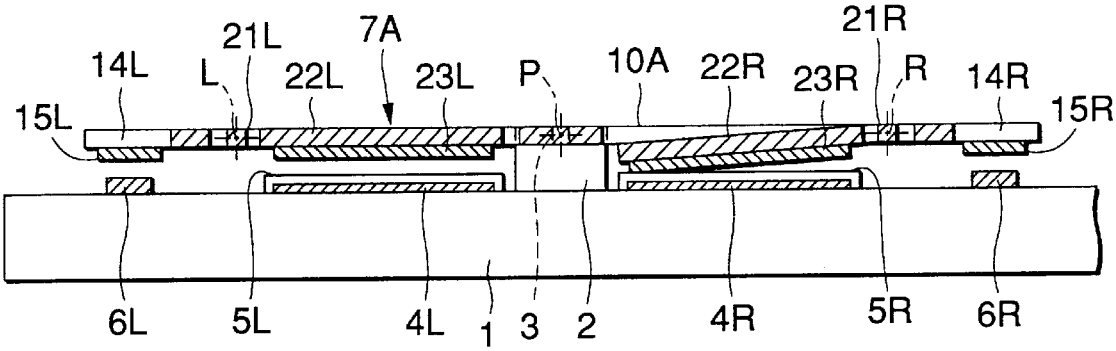
FIG. 28 is a front cross sectional view showing an intermediate state of the operation for turning the contacts on in the sixth embodiment of the present invention.
Figure 29:
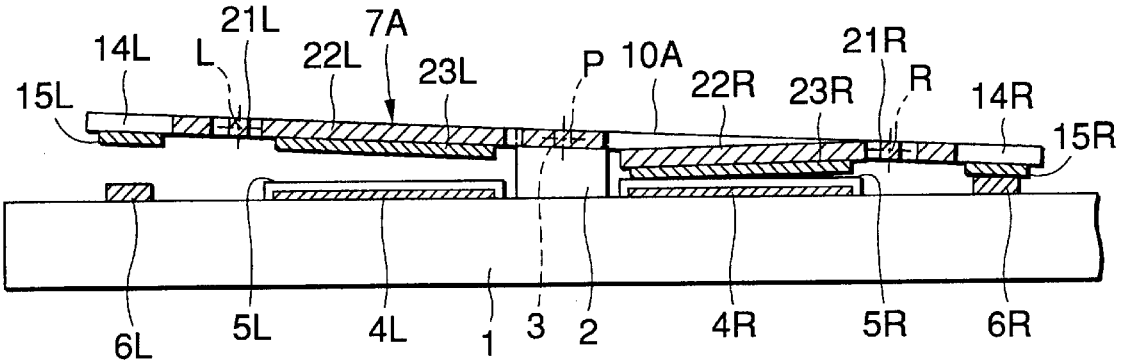
FIG. 29 is a front cross sectional view showing a state in which the operation for turning the contacts on has been completed in the sixth embodiment.

FIG. 27 shows the positions of the electrodes and contacts in a non-operation state (in a state in which no voltage is applied). The fixed contacts 6L and 6R and the movable contacts 15L and 15R are opened. When voltage is applied between the fixed electrode 4R and the movable electrode 23R constituting the right-hand electrostatic actuator, electrostatic attractive force is generated between the two electrodes. Thus, the movable-electrode support portion 22R is rotated by dint of the torsional elasticity of the elastic torsional portion 21R in the form of the beam shape such that the rotation fulcrum R serves as the center. Thus, the movable-electrode support portion 22R is deformed to the position of contact with the substrate 1 (deformed until the movable electrode 23R is brought into contact with the insulating layer 5R covering the fixed electrode 4R), as shown in FIG. 28. The electrostatic attractive force acting between the fixed electrode and the movable electrode of the electrostatic actuator is inverse proportion to the square of the distance. Therefore, as can be understood from also FIG. 28, considerably large electrostatic attractive force is generated between the fixed electrode 4R and the movable electrode 23R, the distance between which has been shortened such that a wedge shape air gap is maintained. Thus, large attractive force for narrowing the wedge shape air gap is generated. As shown in FIG. 29, the movable structure portion 10A which is the main body of the relay structure 7A is rotated to the right such that the rotation fulcrum P serves as the center of rotation. As a result, the movable contact 15R and the fixed contact 6R are brought into contact with each other. Thus, the relay contact is closed.

In a state where the relay contact has been closed, the wedge shape air gap between the movable electrode 23R and the fixed electrode 4R is narrowed. Therefore, a high contact pressure can be obtained.

As described above, the electrostatic relay according to the sixth embodiment of the present invention has the structure that the movable-electrode support portion 22R which is rotated with small force is initially operated in an initial stage of application of voltage to the electrostatic actuator in which the distance between the electrodes of the electrostatic actuator is long and the electrostatic attractive force is small. Thus, the distance between the electrodes is shortened. The shortened distance between the electrodes causes considerably large force to be generated between the electrodes of the electrostatic actuator. The generated force rotates the main body of the relay structure 7A, that is, the movable structure portion 10A which is an outer frame portion of the movable-electrode support portion such that the rotation fulcrum P serves as the center of rotation. Thus, the relay contact is closed and higher pressure can be applied between the contacts.

The electrostatic relay according to the sixth embodiment of the present invention and the electrostatic relay according to the fifth embodiment of the same will now be compared with each other. The electrostatic relay according to the sixth embodiment has the structure that the movable-electrode support portion 22R has the rotation fulcrum R which is the end of the relay structure 7A. Shift of the state shown in FIG. 21 to the state shown in FIG. 22 according to the fifth embodiment and shift of the state shown in FIG. 28 to that shown in FIG. 29 are compared with each other. Since the force for rotating the movable structure portion 10A of the main body of the relay structure 7A is applied to the rotation fulcrum R of the movable-electrode support portion 22R distant from the rotation fulcrum P of the movable structure portion 10A, larger rotational force can be used to rotate the movable structure portion 10A by dint of the principle of a lever.

Therefore, as compared with the electrostatic relay according to the fifth embodiment, when the electrostatic relay is operated with the same operating voltage, the elastic modulus of the elastic torsional portion 3 for supporting the movable structure portion 10A which is the main body of the relay structure 7A can furthermore be enlarged. Therefore, fixed contacts can easily be separated from each other if fixing of the contacts takes place.

That is, as compared with the conventional electrostatic relay, when the operation is performed with the same voltage, the failure of the type that the contacts are fixed can furthermore be prevented as compared with the electrostatic relay according to the fifth embodiment. Thus, a higher contact electric current can be passed. If the contact capacity is the same as that of the conventional electrostatic relay, the operation can be performed with lower operating voltage.

As can be understood from a comparison between FIGS. 22 and 29, the wedge shape air gap formed between the movable electrode and the fixed electrode in the state in which the relay contact has been closed is smaller in the sixth embodiment as compared with the fifth embodiment. Thus, larger electrostatic attractive force can be generated, the contact pressure between the fixed contact and the movable contact can be raised and the contact resistance can be lowered.

Therefore, in the sixth embodiment, the contact resistance caused when the contacts have been closed can furthermore be lowered. Therefore, if the same contact electric current is passed, the generation of Joule heat in the contact portion can be prevented. Thus, generation of the melting of the contacts owning to rise in the temperature of the contact portion can furthermore be prevented.

A structure may be employed in which the torsional elasticity of each of the elastic torsional portions 21L and 21R in the form of the beam shape for rotatively connecting the movable-electrode support portions 22L and 22R to the movable structure portion 10A and the torsional elasticity of the elastic torsional portion 3 in the form of the beam shape are made to similar to each other. Thus, the force required to rotate the movable-electrode support portions 22L and 22R and that required to rotate the movable structure portion 10A to be similar to each other. In the foregoing case, the processes shown in FIGS. 28 and 29 take place simultaneously. Also in the foregoing case, the forces for bringing the relay contacts (fixed contacts 6L and 6R and the movable contacts 15L and 15R) into contact with each other are finally made to be similar to each other.

The operation for opening the contacts will now be described.

Figure 30:
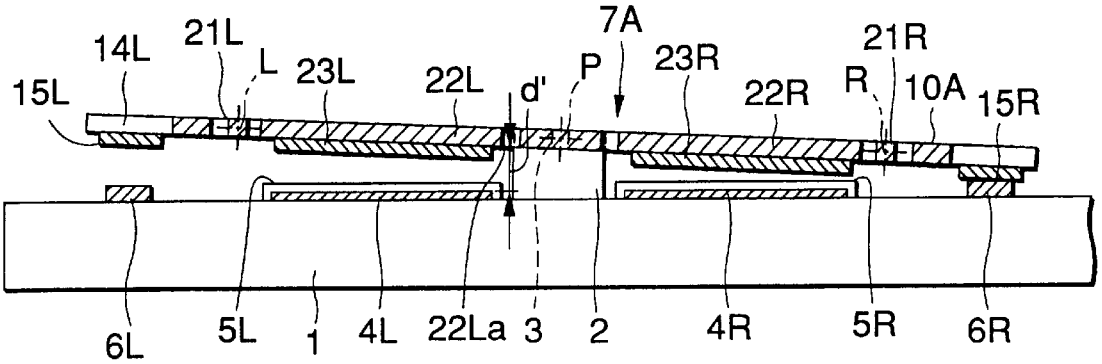
FIG. 30 is a front cross sectional view showing a state in which the voltage applied to the electrostatic actuator has been made to be zero after the contacts have been turned on in the sixth embodiment.

FIG. 30 shows a state in which the electrodes of the right-hand electrostatic actuator are short-circuited (the same potential) after the relay contact shown in FIG. 29 has been turned on and thus the right-hand electrostatic attractive force has been made to be zero. In the foregoing state, the force for separating the contacts 6R and 15R from each other is only the restoring force generated by the elastic modulus of the elastic torsional portion 3 in the form of the beam shape for elastically supporting the movable structure portion 10A which is the main body of the relay structure 7A.

If the force for fixing the contacts 6R and 15R to each other is larger than the foregoing restoring force, the contacts of the electrostatic relay are not opened. Thus, a failure of the type that the contacts are fixed takes place.

Also the sixth embodiment has the structure that voltage is applied between the electrodes of the left-hand electrostatic actuator so as to cause the movable structure portion 10A which is the main body of the relay structure 7A to perform the seesaw motion. Thus, the force for separating the right-hand contact is generated.

Figure 31:
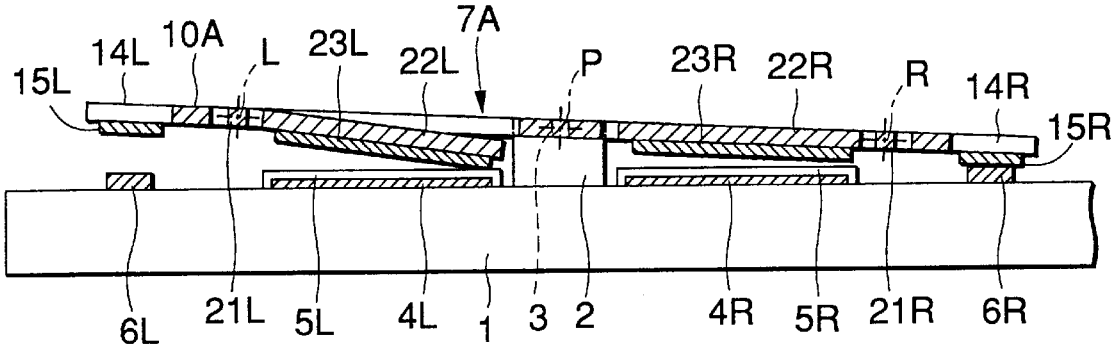
FIG. 31 is a front cross sectional view showing an intermediate state of the operation for turning the contacts off in the sixth embodiment.

The operation at the foregoing time is shown in FIGS. 30 and 31. As can be understood from FIG. 30, the electrostatic relay according to this embodiment has the structure that the movable end 22L*a* of the left-hand movable-electrode support portion 22L of the electrostatic relay is positioned adjacent to the rotation fulcrum P of the movable structure portion 10A. Therefore, although the movable structure portion 10A is inclined to the right, distance d' from the movable end 22L*a* to the fixed electrode 4L opposite to the movable end 22L*a* is substantially the same as distance d realized in a stationary state shown in FIG. 27.

The force for rotating the movable-electrode support portion 22L is the force of a lever with respect to the rotation fulcrum L. The distance d' from the movable end 22L*a* to the fixed electrode is substantially the same as that in the stationary state shown in FIG. 27 (that is, also the distance from the end of the movable electrode 23L adjacent to the movable end 22L*a* which generates maximum rotational force to the fixed electrode is substantially the same as that realized in the stationary state shown in FIG. 27). Therefore, application of voltage between the electrodes causes the movable-electrode support portion 22L to easily be rotated. Thus, shift to the state shown in FIG. 31 can be performed. When the movable end 22L*a* of the movable-electrode support portion 22L and the end of the movable electrode 23L are formed adjacently to each other as much as possible, the restoring force can efficiently be generated.

Therefore, if the elastic modulus of each of the elastic torsional portions 21L and 21R in the form of the beam shape for rotatively supporting the movable-electrode support portions 22L and 22R is not made to be a small value as is set in the fifth embodiment shown in FIGS. 23 and 24, application of usual operating voltage enables the movable-electrode support portion 22L to reliably be rotated. Thus, the distance from the movable electrode 23L to the fixed electrode 4L can be shortened.

As shown in FIG. 31, considerably large electrostatic attractive force is generated between the movable electrode 23L and the fixed electrode 4L, the distance between which has been shortened in the form of the wedge shape air gap. Thus, large force for narrowing the wedge shape air gap can be generated.

Figure 32:
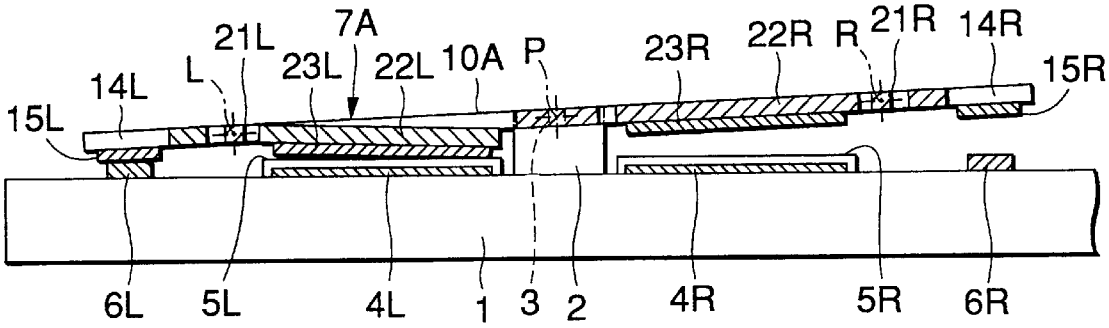
FIG. 32 is a front cross sectional view showing a state in which the operation for turning the contacts off has been completed in the sixth embodiment.

As described above, with the electrostatic relay according to the sixth embodiment, even if the right-hand relay contact is fixed, application of usual operating voltage between the left-hand electrodes causes the movable-electrode support portion 22L to reliably be rotated. Thus, the operation is performed in the initial stage of the application of the voltage to the electrostatic actuator in which the distance between the electrodes of the electrostatic actuator is short and the electrostatic attractive force is small so that the distance between the electrodes is shortened. As a result of the shortened distance between the electrodes, considerably large force is generated between the electrodes of the electrostatic actuator. The generated force rotates the movable structure portion 10A so that the right-hand relay contacts, that is, the fixed contact 6R and the movable contact 15R are opened, as shown in FIG. 32.

In the electrostatic relay according to this embodiment, the movable-electrode support portion 22L is rotated such that the end of the movable structure portion 10A which is the main body of the relay structure 7A of the movable-electrode support portion 22L serves as the fulcrum of rotation. Therefore, when the state shown in FIG. 31 to the state shown in FIG. 32, as compared with the shift according to the fifth embodiment to the state shown in FIG. 25, the force for rotating the movable structure portion 10A acts on the fulcrum L of the movable-electrode support portion 22L distant from the rotation fulcrum P of the movable structure portion 10A. Therefore, the principle of a lever enables the movable structure portion 10A to be rotated with larger force. Therefore, employment of the structure according to this embodiment enables larger force for separating the fixed contacts to be generated as compared with the fifth embodiment.

If the contacts encounter the phenomenon of melting, the electrostatic relay according to the sixth embodiment of the present invention is able to generate separating force which is larger than the separating force which can be generated in the fifth embodiment as compared with the conventional electrostatic relay when voltage is applied to the electrostatic actuator opposite to the melted contacts. Thus, the failure of melting of the contacts can furthermore reliably be prevented. The other operations and effects are similar to those obtainable from the foregoing fifth embodiment.

The foregoing fifth and sixth embodiments have the structure that one pair of the movable-electrode support portion and a movable electrode is provided with respect to the relay structure. The present invention is not limited to this. For example, plural pairs of the movable electrode portions (that is, the movable-electrode support portions and movable electrodes) may be provided to be adaptable to the shape of the relay structure. If the same function can be realized, a thru structure except for the symmetrical structure may be employed to meet a purpose.

Although the foregoing fifth and sixth embodiments have the structure that the movable electrodes are formed on the surface of the substrate of the relay structure, the positions of the electrodes are not limited to the foregoing positions. The necessity substantially lies in that the electrostatic attractive force can be generated between the fixed electrode and the movable electrode. If the relay structure is made of an insulating material having a high dielectric constant or a high-resistance material, the movable electrode may be disposed on the opposite surface of the substrate of the relay structure. If the relay structure is made of a conductive material, the relay structure may be formed into the movable electrode (in the foregoing case, the movable-electrode support portion is not required and the movable electrode portion forms the movable electrode).

As the positions of the relay contacts composed of the pairs of the fixed contacts and the movable contacts, the foregoing embodiments have been described about the structure which is able to form a relay circuit having the relay contacts at the two ends of the relay structure to perform the complementary operation. If a single contact is permitted, the relay contact may be provided for only one side. A plurality of contacts may be provided for the relay structure so as to permit simultaneously opening/closing of a plurality of circuits.

In the above-mentioned fifth and sixth embodiments, torsional elastic portions in the form of the beam shape are employed as the elastic connection portions for connecting the movable structure portion and the movable electrode portion which form the main body of the relay structure. If a similar function can be realized, a structure except for the torsional elastic portion may be employed.

The present invention will furthermore specifically be described such that examples will now be described.

Figure 33:
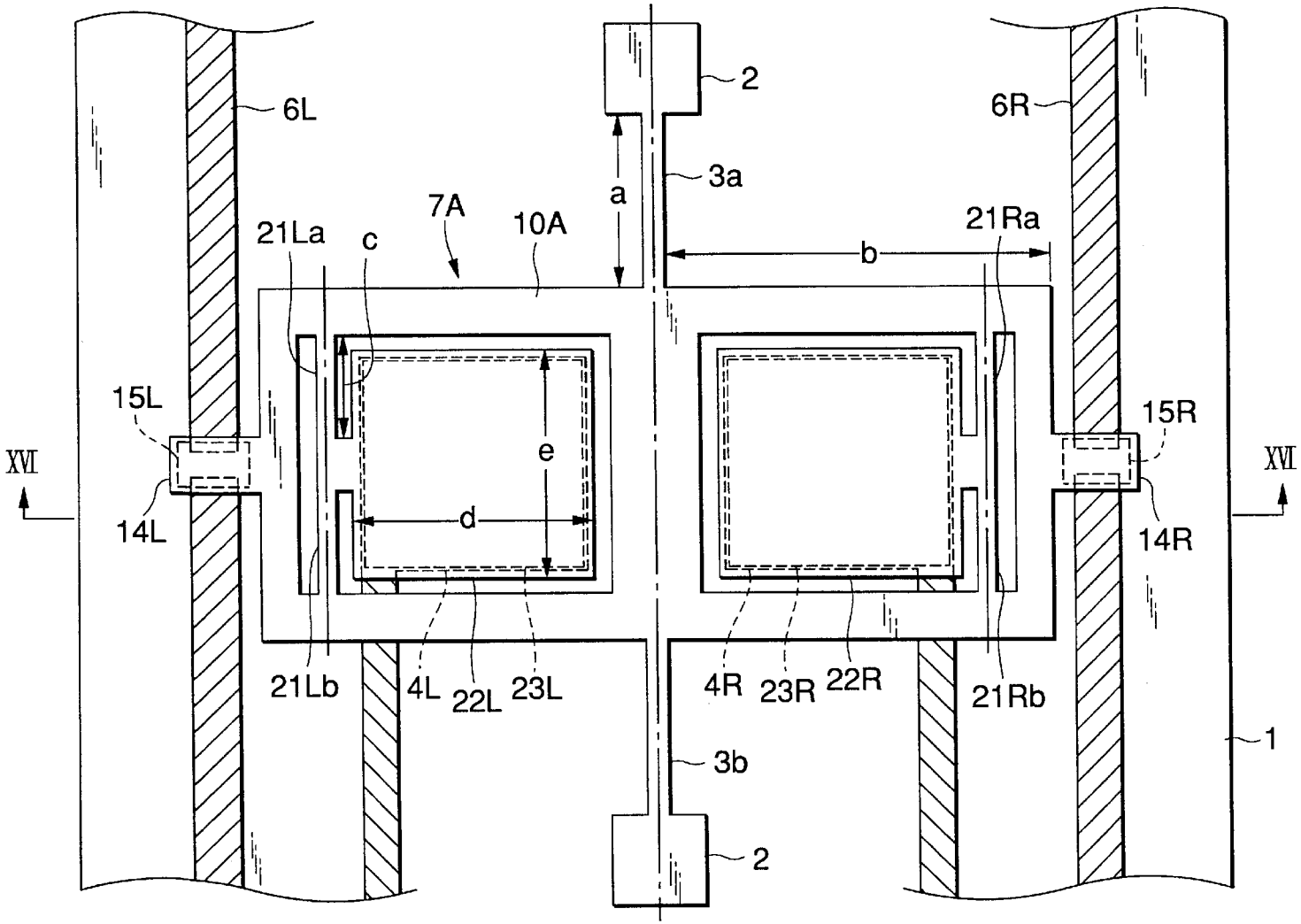
FIG. 33 is a plan view showing the embodiment of the present invention.
Figure 34:
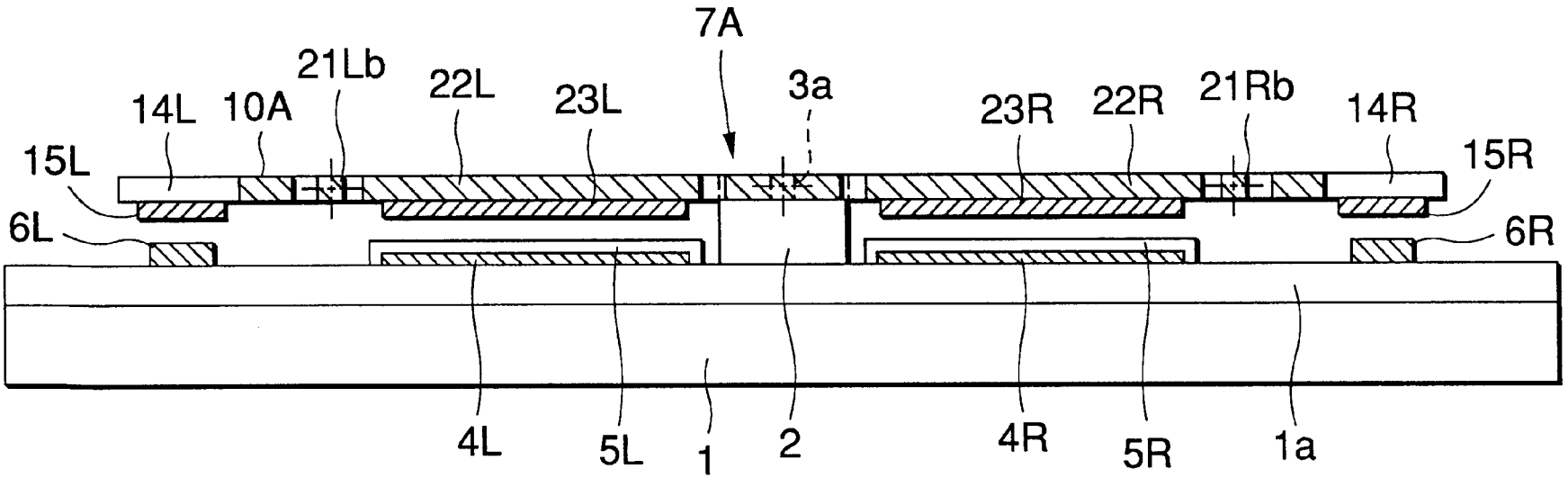
FIG. 34 is a front cross sectional view taken along line XVI—XVI shown in FIG. 33.
Figure 35A:
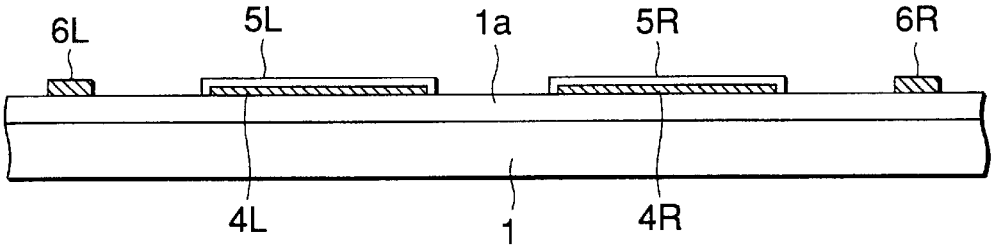
FIGS. 35A to 35C are diagrams showing a process for manufacturing the electrostatic relay according to the embodiment of the present invention.

FIGS. 33 and 34 are a plan view and a front cross sectional view showing an electrostatic relay according to this example. The foregoing electrostatic relay has a structure similar to that according to the sixth embodiment. In this example, a single crystal Si plate 1 having a SiO2 insulating layer 1*a* having a thickness of about 1 $\mu$m and formed by a thermal oxidation method as shown in FIG. 35A was used as the substrate. Then, Au having a thickness of about 500 nm was formed on the overall surface of the substrate by a sputtering method. Then, a photoetching method was employed so that the fixed electrodes 4L and 4R of the electrostatic actuator and the fixed contacts 6L and 6R of the relay were patterned. Then, a reactive sputtering method was employed to form a SiN insulating layer having a thickness of about 100 nm on the overall surface of the substrate. Similarly, the photoetching method was employed to selectively remove the foregoing insulating layer such that the fixed electrodes 4L and 4R of the electrostatic actuator were left. Thus, insulating layers 5L and 5R were formed.

Figure 35B:
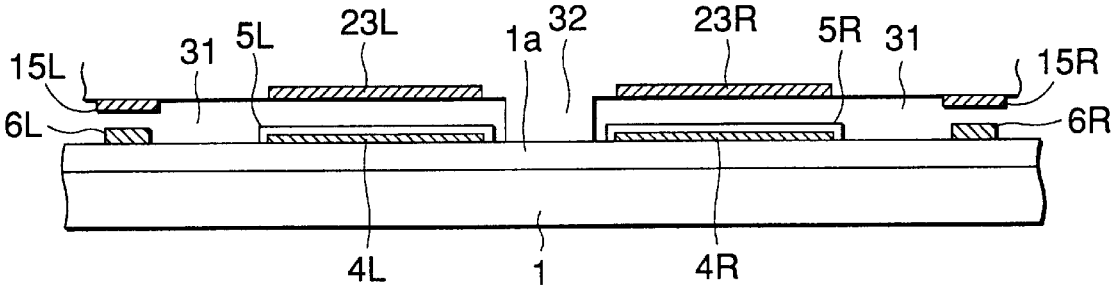

Then, a vacuum CVD method was employed as shown in FIG. 35B so that a SiO2 film which was formed into a sacrifice layer 31 was deposited on the overall surface of the substrate such that the thickness of the SiO2 film was about 3 μm. Subsequently, an RIE method is employed to selectively etch portions of SiO2 film corresponding to the movable contacts 15L and 15R by approximately 500 nm. Then, an Au film having a thickness of about 500 nm was formed on the overall surface of the substrate together with a SiN reaction preventive layer having a thickness of about 20 nm. Then, patterning into predetermined shapes was performed by photoetching so that the movable electrodes 23L and 23R of the electrostatic actuator and the movable contacts 15L and 15R of the relay were formed. Then, a portion 32 of the sacrifice layer 31 corresponding to the anchor structure 2 in the form of the SiO2 film was selectively removed by using photoetching.

Figure 35C:
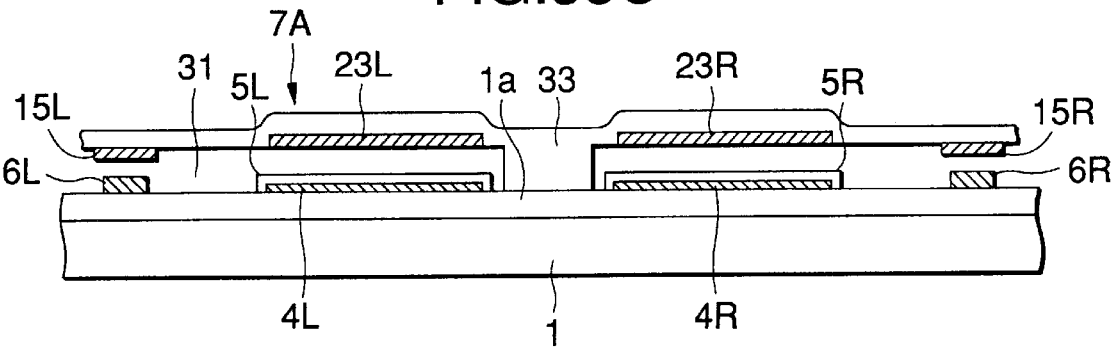

Finally, the vacuum CVD method was employed to form a polycrystal Si film 33 on the overall surface of the substrate to have a thickness of about 4 μm, as shown in FIG. 35C, and then patterned into the shape of the relay structure 7A to be described later by using a RIE method. Then, the SiO2 film of the sacrifice layer 31 was selectively etched by HF so that the relay structure 7A as shown in FIGS. 33 and 34 was obtained by releasing.

As shown in FIG. 33, the relay structure 7A incorporates elastic torsional portions 3*a* and 3*b* having length a which was about 140 μm from the anchor structure 2 and a width of about 6 μm and formed into the beam shape; the movable structure portion (the frame portion) 10A extending to the right and left from the elastic torsional portions 3*a* and 3*b* in the form of the beam shape such that each of the portions had a length b of about 220 mm and serving as the main body of the relay structure 7A; the torsional elastic portions 21L*a*, 21L*b*, 21R*a* and 21R*b* formed at positions extending, for about 200 μm, to the right and left from the elastic torsional portions 3*a* and 3*b* in the form of the beam shape, each having a length c of about 80 μm and a width of about 3 μm and formed into the beam shape; the movable-electrode support portions 22L and 22R connected to the foregoing elastic portions and having a length d of about 150 μm and a width e of about 200 μm; and the movable-contact support portions 14L and 14R having a length of about 50 μm. The overall body of the relay structure 7A including the foregoing elements is rotatable by the torsional elasticity of each of the elastic torsional portions 3*a* and 3*b* in the form of the beam shape. Moreover, the movable-electrode support portions 22L and 22R can be rotated by the torsional elasticity of each of the torsional elastic portions 21L*a*, 21L*b*, 21R*a* and 21R*b* in the form of the beam shape.

When operating voltage of about not higher than 20 V was applied between right or left electrostatic actuators of the electrostatic relay according to the present invention, the relay contacts were closed. At this time, the contact resistance was about 0.2 Ω. When 100 mA contact electric current was passed, the contacts were free from melting. When 200 mA contact electric current was passed, the contacts were melted. However, application of the operating voltage to the electrostatic actuator opposite to the melted relay contact enabled the contacts to easily be restored.

As described above, the electrostatic relay according to this embodiment enables satisfactorily practical characteristics as a relay for small signals to be obtained. For example, the shape and dimensions are changed such that the thickness of the SiO2 film which is formed into the sacrifice layer 31 in the manufacturing process shown in FIGS. 35A to 35C can be reduced and the areas of the electrodes of the electrostatic actuator can be enlarged. Thus, the operation can be performed with lower voltage.

As a comparative example, a conventional structure was manufactured which had a similar basic structure and dimensions and which was not provided with the rotatable movable-electrode support portion and in which the movable electrodes were secured to the main body of the relay structure so as to be evaluated. As a result, although the operating voltage was about not higher than 20 V, high contact resistance of 5 Ω to 10 Ω was realized. To lower the contact resistance to 1 Ω or lower, an operating voltage of 40 V or higher is required. When a contact electric current of several mA was passed, the contacts were melted. Thus, the operation for turning the structure off was impossible. Even if an operating voltage of 20 V was applied to the electrostatic actuator opposite to the melted contacts, the contacts could not be opened.

As described above, employment of the electrostatic relay according to the present invention enables a practical electrostatic relay to be formed which exhibits low-voltage operation, low contact resistance, a high contact capacity and satisfactory reliability.

Although the foregoing embodiments have been described about the structure in which the relay structure is formed by using the thin film forming technique, the method of forming the electrostatic relay according to the present invention is not limited to the foregoing method. For example, a method may be employed in which a movable contact and a movable electrode are formed on a single-crystal Si substrate to obtain the relay structure. Then, an anisotropic etching technique or the like is employed to realize a required shape so as to be bonded to an insulating substrate similarly having a fixed contact and a fixed electrode through a spacer.

Also in the above-mentioned case, an electrostatic relay can be obtained with which a large contact capacity and low-voltage operation can easily be realized as compared with the conventional structure and which exhibits satisfactory reliability.

As the relay structure, a thin metal plate having a surface subjected to an insulating process may be employed. The electrostatic relay manufactured by the above-mentioned method can be applied to a purpose in which a higher contact electric current is passed as compared with the electrostatic relay manufactured by the thin film forming technique.

Although the invention has been described in its preferred form, it is understood that the present disclosure of the preferred form can be changed in the details of construction and in the combination and arrangement of parts without departing from the spirit and the scope of the invention as hereinafter claimed.

As described above, according to the present invention, the problems experienced with the conventional electrostatic relay in that the contact electrodes are easily melted and fixed, a sufficiently high contact electric current cannot be maintained and reliability and practicality are unsatisfactory can be overcome. Thus, an electrostatic relay can be realized which exhibits low contact resistance, a large contact electric current capacity and low operating voltage, with which failures of a type that the contacts are melted and fixed and which has satisfactory reliability.

Since the characteristics as the relay can significantly be improved, the electrostatic relay according to the present invention enables a relay exhibiting satisfactory practicality as compared with the conventional electrostatic relay to be constituted.

What is claimed is:

1. An electrostatic relay comprising:

a substrate;

a torsional elasticity portion supported on said substrate such that a gap is maintained from said substrate and arranged to have a beam shape;

a movable structure portion rotatably supported by said torsional elasticity portion;

at least one movable contact provided at an end of said movable structure portion;

a movable electrode disposed between a fulcrum of rotation of said movable structure portion and said movable contact;

at least one fixed contact formed on said substrate at a position opposite to said movable contact such that contact is permitted; and a fixed electrode formed on said substrate at a position opposite to said movable electrode;

wherein at least one portion between the fulcrum of rotation of said movable structure portion and said movable contact is formed into an elastic connection portion.

2. An electrostatic relay according to claim 1, wherein said elastic connection portion is formed between said movable electrode and said movable contact of said movable structure portion, and when voltage is applied between said movable electrode and said fixed electrode, elastic deformation causes said movable contact and said fixed contact to be brought into contact with each other in a parallel state.

3. An electrostatic relay according to claim 1, wherein said elastic connection portion is formed between said fulcrum of rotation of said movable structure portion and said movable electrode, when voltage is applied between said movable electrode and said fixed electrode, elastic deformation causes said movable electrode to be sucked in parallel with said fixed electrode or into an approach state near the parallel state.

4. An electrostatic relay according to claim 1, wherein said elastic connection portion is portionally deformed.

5. An electrostatic relay according to claim 1, wherein said elastic connection portion is deflectively deformed.

6. An electrostatic relay according to claim 1, wherein said movable electrode is formed on a lower surface of the movable structure portion.

7. An electrostatic relay according to claim 6, wherein a dielectric layer is interposed between said movable electrode and said fixed electrode.

8. An electrostatic relay according to claim 1, wherein said movable electrode is formed on an upper surface of the movable structure portion.

9. An electrostatic relay according to claim 1, wherein said movable structure portions extend to both sides of said torsional elasticity portion, said movable contact is provided for at least either side with respect to said fulcrum of rotation, said movable electrodes are provided for both sides, and said fixed electrodes are formed on said substrate at positions opposite to said movable electrodes.

10. An electrostatic relay comprising:

a substrate;

a torsional elasticity portion supported on said substrate such that a gap is maintained from said substrate and arranged to have a beam shape;

a movable structure portion disposed to intersect said torsional elasticity portion and rotatably supported by said torsional elasticity portion;

movable electrode portions rotatively provided for both sides of a fulcrum of rotation of said movable structure portion through elastic connection portions;

movable electrodes constituted by said movable electrode portions or provided for said movable electrode portions;

fixed electrodes disposed on said substrate at positions opposite to said movable electrodes;

at least one movable contact provided for at least an end of said movable structure portion; and a fixed contact disposed on said substrate at a position opposite to said movable contact such that contact is permitted.

11. An electrostatic relay according to claim 10, wherein a movable end of each of said movable electrode portions is disposed adjacent to said fulcrum of rotation of said movable structure portion.

12. An electrostatic relay according to claim 10, wherein said elastic connection portion has a structure with which said movable electrode is caused to approach said fixed electrode by dint of elastic deformation when voltage is applied between said movable electrode and said fixed electrode.

13. An electrostatic relay according to claim 10, wherein said movable electrode is formed on a lower surface of the movable structure portion.

14. An electrostatic relay according to claim 11, wherein a dielectric layer is interposed between said movable electrode and said fixed electrode.

15. An electrostatic relay according to claim 10, wherein said movable electrode is formed on an upper surface of the movable structure portion.

* * * * *